US009441824B2

(12) United States Patent
Kinnune et al.

(10) Patent No.: US 9,441,824 B2
(45) **Date of Patent: *Sep. 13, 2016**

(54) LED LIGHT FIXTURE WITH HEAT-DISSIPATION-RELATED HIGH LIGHT OUTPUT

(71) Applicant: Cree, Inc., Durham, NC (US)

(72) Inventors: Brian Kinnune, Racine, WI (US); Alan J. Ruud, Racine, WI (US); Kurt Wilcox, Libertyville, IL (US); David P. Goelz, Milwaukee, WI (US)

(73) Assignee: Cree, Inc., Durham, NC (US)

( * ) Notice: Subject to any disclaimer, the term of this patent is extended or adjusted under 35 U.S.C. 154(b) by 399 days.

This patent is subject to a terminal disclaimer.

(21) Appl. No.: 13/839,922

(22) Filed: Mar. 15, 2013

(65) Prior Publication Data

US 2014/0104836 A1 Apr. 17, 2014

Related U.S. Application Data

(63) Continuation-in-part of application No. 13/680,481, filed on Nov. 19, 2012, now Pat. No. 8,622,584, which is a continuation of application No. 13/333,198, filed on Dec. 21, 2011, now Pat. No. 8,313,222, which is a continuation of application No. 12/418,364, filed on Apr. 3, 2009, now Pat. No. 8,092,049.

(60) Provisional application No. 61/624,211, filed on Apr. 13, 2012, provisional application No. 61/042,690, filed on Apr. 4, 2008.

(51) Int. Cl.
*F21V 29/00* (2015.01)
*F21V 31/03* (2006.01)
(Continued)

(52) U.S. Cl.
CPC ..... *F21V 29/2293* (2013.01); *F21K 9/00* (2013.01); *F21V 15/013* (2013.01);
(Continued)

(58) Field of Classification Search
CPC .. F21V 29/2293; F21V 29/004; F21V 31/03; F21V 15/013; F21V 15/015; F21V 17/107; F21V 19/0055; F21V 19/045; F21V 23/002; F21V 29/74; F21V 29/75; F21V 29/763; F21V 29/83; F21K 9/00; F21S 2/005; F21S 8/086; F21W 2131/103; F21Y 2101/02; F21Y 2105/001
USPC ..... 362/294
See application file for complete search history.

(56) References Cited

U.S. PATENT DOCUMENTS

D155,488 S 5/1949 Crockett
4,228,489 A 10/1980 Martin
(Continued)

FOREIGN PATENT DOCUMENTS

CN 101093073 A 12/2007
CN 101101102 A 1/2008
(Continued)

OTHER PUBLICATIONS

"Miscellaneous Shape Heat Sinks," brochure excerpt. National Northeast Corporation, Pelhan, NH. Undated.
(Continued)

*Primary Examiner* — Anh Mai
*Assistant Examiner* — Hana Featherly
(74) *Attorney, Agent, or Firm* — Jansson Munger; McKinley & Kirby Ltd.

(57) ABSTRACT

An LED floodlight fixture LED light fixture including a plurality of heat-sink-mounted LED-array modules, each module engaging an LED-adjacent surface of a heat-sink base for transfer of heat from the module, and at least one venting aperture through the heat-sink base to provide air ingress to the heat-dissipating surfaces adjacent to the aperture. The LED light fixture may include a plurality of heat sinks, each heat sink with its own heat-dissipating surfaces and heat-sink base which has one of the LED-array modules engaged thereon. The heat-sink base is wider than the module thereon such that the heat-sink base includes a beyond-module portion. The venting aperture(s) is/are through the beyond-module portion of the heat-sink base. The inventive light fixture may include a housing and an LED assembly which includes the heat-sink-mounted LED-array modules. The LED assembly and the housing form a venting gap therebetween to provide air ingress along the heat-sink base to the heat-dissipating surfaces.

37 Claims, 20 Drawing Sheets

(51) Int. Cl.

| | |
|---|---|
| ***F21K 99/00*** | (2016.01) |
| ***F21V 15/01*** | (2006.01) |
| ***F21V 15/015*** | (2006.01) |
| ***F21V 17/10*** | (2006.01) |
| ***F21V 19/00*** | (2006.01) |
| ***F21V 19/04*** | (2006.01) |
| ***F21V 23/00*** | (2015.01) |
| ***F21V 29/74*** | (2015.01) |
| ***F21V 29/75*** | (2015.01) |
| ***F21V 29/76*** | (2015.01) |
| ***F21V 29/83*** | (2015.01) |
| *F21S 2/00* | (2016.01) |
| *F21S 8/08* | (2006.01) |
| *F21W 131/103* | (2006.01) |
| *F21Y 101/02* | (2006.01) |
| *F21Y 105/00* | (2016.01) |

(52) U.S. Cl.

CPC ..... *F21V 15/015* (2013.01); *F21V 17/107* (2013.01); *F21V 19/0055* (2013.01); *F21V 19/045* (2013.01); *F21V 23/002* (2013.01); *F21V 29/004* (2013.01); *F21V 29/74* (2015.01); *F21V 29/75* (2015.01); *F21V 29/763* (2015.01); *F21V 29/83* (2015.01); *F21V 31/03* (2013.01); *F21S 2/005* (2013.01); *F21S 8/086* (2013.01); *F21W 2131/103* (2013.01); *F21Y 2101/02* (2013.01); *F21Y 2105/001* (2013.01)

(56) References Cited

U.S. PATENT DOCUMENTS

| | | | | |
|---|---|---|---|---|
| 4,931,917 | A | 6/1990 | Scherf et al. | |
| D319,702 | S | 9/1991 | Kane | |
| D354,558 | S | 1/1995 | Marvin et al. | |
| D355,722 | S | 2/1995 | Roos et al. | |
| 5,398,177 | A | 3/1995 | Harwood | |
| 5,593,225 | A | 1/1997 | Safyan | |
| 6,565,238 | B1 | 5/2003 | Pyrtle | |
| 6,657,862 | B2 | 12/2003 | Crocker et al. | |
| D505,220 | S | 5/2005 | Stekelenburg | |
| 6,942,361 | B1 * | 9/2005 | Kishimura et al. | 362/240 |
| 7,063,451 | B2 | 6/2006 | Shen | |
| D536,816 | S | 2/2007 | Mier-Langner et al. | |
| D536,817 | S | 2/2007 | Mier-Langner et al. | |
| D537,972 | S | 3/2007 | Mier-Langner et al. | |
| D537,973 | S | 3/2007 | Mier-Langner et al. | |
| D538,459 | S | 3/2007 | Rose et al. | |
| D538,961 | S | 3/2007 | Mier-Langner et al. | |
| D539,460 | S | 3/2007 | Mier-Langner et al. | |
| D539,956 | S | 4/2007 | Rose et al. | |
| D543,657 | S | 5/2007 | Lehman | |
| D550,885 | S | 9/2007 | Crosby | |
| D551,379 | S | 9/2007 | Maxik | |
| D563,013 | S | 2/2008 | Levine | |
| D563,580 | S | 3/2008 | Prazoff | |
| D563,582 | S | 3/2008 | Levine | |
| D564,117 | S | 3/2008 | Lippert | |
| D571,032 | S | 6/2008 | Chen | |
| D580,082 | S | 11/2008 | Zemar | |
| D581,080 | S | 11/2008 | Mier-Langner | |
| 7,513,639 | B2 | 4/2009 | Wang | |
| D599,494 | S | 9/2009 | Levine | |
| D600,400 | S | 9/2009 | Friedman | |
| 7,665,699 | B2 | 2/2010 | Oddsen, Jr. et al. | |
| 7,686,469 | B2 | 3/2010 | Ruud et al. | |
| D619,291 | S | 7/2010 | Thevenot | |
| D626,264 | S | 10/2010 | Liu | |
| D638,566 | S | 5/2011 | Goelz et al. | |
| 8,092,049 | B2 | 1/2012 | Kinnune et al. | |
| 8,313,222 | B2 | 11/2012 | Kinnune et al. | |
| 2003/0048608 | A1 | 3/2003 | Crocker et al. | |
| 2005/0128752 | A1 | 6/2005 | Ewington et al. | |
| 2005/0258446 | A1 | 11/2005 | Raos et al. | |
| 2006/0193139 | A1 | 8/2006 | Sun et al. | |
| 2007/0086196 | A1 | 4/2007 | Wong | |
| 2007/0115666 | A1 | 5/2007 | Thomas et al. | |
| 2008/0037239 | A1 | 2/2008 | Thomas et al. | |
| 2008/0043479 | A1 * | 2/2008 | Wang | 362/373 |
| 2008/0080162 | A1 | 4/2008 | Wilcox et al. | |
| 2008/0080189 | A1 | 4/2008 | Wang | |
| 2008/0080196 | A1 | 4/2008 | Ruud et al. | |
| 2009/0251898 | A1 | 10/2009 | Kinnune et al. | |
| 2009/0268477 | A1 | 10/2009 | Zheng et al. | |
| 2010/0026158 | A1 | 2/2010 | Wu | |
| 2010/0046223 | A1 | 2/2010 | Li et al. | |

FOREIGN PATENT DOCUMENTS

| | | | |
|---|---|---|---|
| CN | 101101103 | A | 1/2008 |
| CN | 101101104 | A | 1/2008 |
| CN | 101101106 | A | 1/2008 |
| CN | 101101107 | A | 1/2008 |
| CN | 101105268 | A | 1/2008 |
| CN | 101105278 | A | 1/2008 |
| EP | 1431653 | A2 | 6/2004 |
| EP | 1760393 | A1 | 3/2007 |
| EP | 1906081 | A1 | 4/2008 |
| WO | 2006060905 | A1 | 6/2006 |

OTHER PUBLICATIONS

"LED Light Sources" product description. Aavid Thermalloy. Date: Copyright 2006.

* cited by examiner

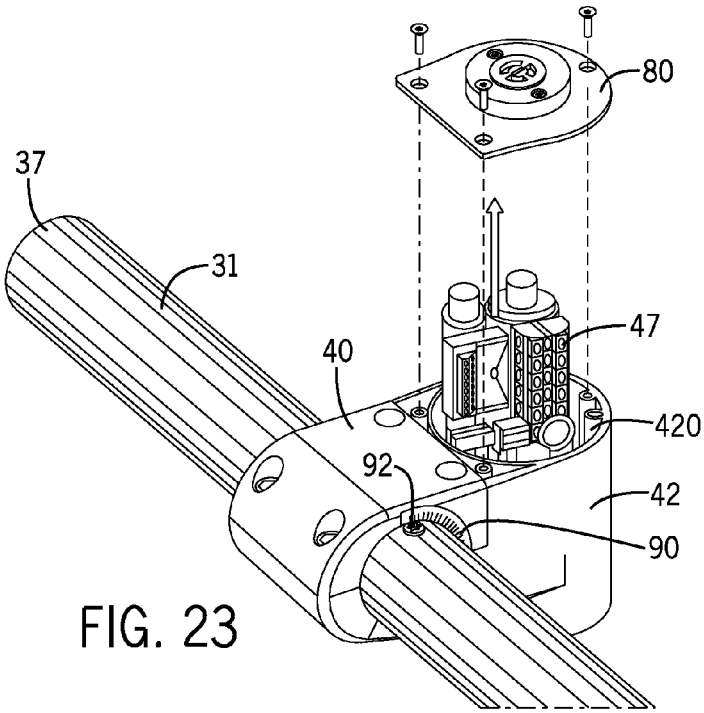
FIG. 23
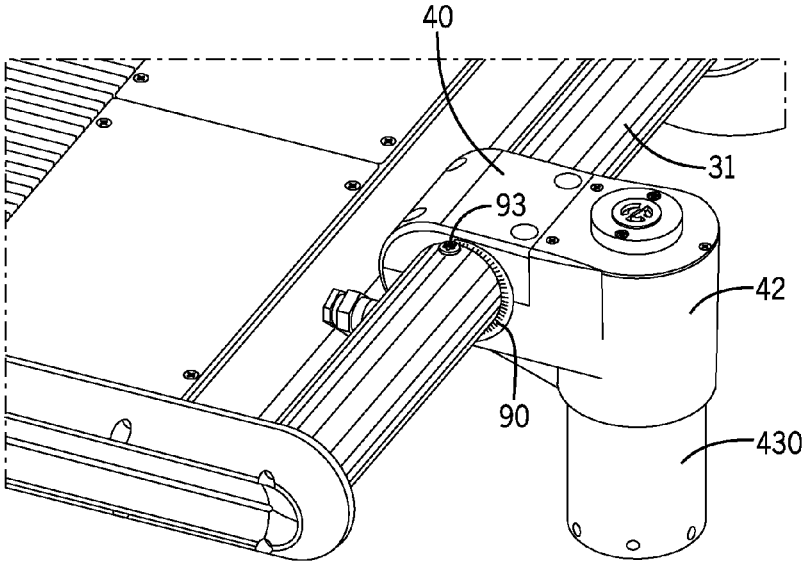
FIG. 24
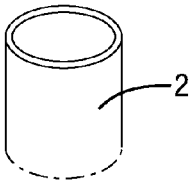

LED LIGHT FIXTURE WITH HEAT-DISSIPATION-RELATED HIGH LIGHT OUTPUT

RELATED APPLICATION

This application is based in part on U.S. Provisional Application Ser. No. 61/624,211, filed Apr. 13, 2012. This application is also a continuation-in-part of patent application Ser. No. 13/680,481, filed Nov. 19, 2012, which in turn is a continuation of patent application Ser. No. 13/333,198, filed Dec. 21, 2011, now U.S. Pat. No. 8,313,222, issued Nov. 20, 2012, which in turn is a continuation of patent application Ser. No. 12/418,364, filed Apr. 3, 2009, now U.S. Pat. No. 8,092,049, issued Jan. 10, 2012, which in turn is based in part on U.S. Provisional Application Ser. No. 61/042,690, filed Apr. 4, 2008. The entirety of the contents of all such applications are incorporated herein by reference.

FIELD OF THE INVENTION

This invention relates to light fixtures and, more particularly, to street and roadway light fixtures and the like, including light fixtures for illumination of large areas. More particularly, this invention relates to such light fixtures which utilize LEDs as light source.

BACKGROUND OF THE INVENTION

Light fixtures such as floodlights are often used for illumination of a selected area or object and typically need to be adjusted into a desired orientation for maximal effect. Adjustable light fixtures are popular with architects, lighting designers and building owners as a way to visually "highlight" certain building and landscape features and improve the nighttime appearance of buildings and grounds.

Large properties such as auto dealerships may require, e.g., a dozen or even several dozen well-placed floodlights for the intended illumination purpose. Architects and lighting designers are justifiably concerned that each floodlight be capable of being precisely directed toward the particular feature to be illuminated. This means that the floodlight should have a mounting arrangement that permits a wide range of aiming angles.

High-luminance light fixtures using LED modules as light source present particularly challenging problems. One particularly challenging problem for high-luminance LED light fixtures relates to heat dissipation. Among the advances in the field are the inventions disclosed in co-owned patent application Ser. No. 11/860,887, filed Sep. 25, 2007, now U.S. Pat. No. 7,686,469, issued Mar. 30, 2010, the entirety of the contents of this application is incorporated herein by reference.

Improvement in dissipating heat to the atmosphere is one significant objective in the field of LED light fixtures. It is of importance for various reasons, one of which relates to extending the useful life of the lighting products. Achieving improvements without expensive additional structure and apparatus is much desired. This is because a major consideration in the development of high-luminance LED light fixtures for various high-volume applications, such as roadway lighting, is controlling product cost even while delivering improved light-fixture performance.

In summary, finding ways to significantly improve the dissipation of heat to the atmosphere from LED light fixtures would be much desired, particularly in a fixture that is easy and inexpensive to manufacture.

SUMMARY OF THE INVENTION

The present invention relates to improved LED light fixtures. The LED light fixture may include a plurality of heat-sink-mounted LED-array modules, each module engaging an LED-adjacent surface of a heat-sink base for transfer of heat from the module. Heat-sink heat-dissipating surfaces may extend away from the modules. In certain embodiments, the inventive LED light fixture includes at least one venting aperture through the heat-sink base to provide air ingress to the heat-dissipating surfaces adjacent to the aperture.

In some of such embodiments, the LED light fixture includes a plurality of heat sinks, each heat sink with its own heat-dissipating surfaces and heat-sink base. Each heat-sink base may have one of the LED-array modules engaged thereon and being wider than the module thereon such that the heat-sink base includes a beyond-module portion.

The at least one venting aperture may include at least one venting aperture through the beyond-module portion of the heat-sink base. In some embodiments, the at least one venting aperture along the beyond-module portion of the heat-sink base includes at least two venting apertures along the beyond-module portion. The heat sinks may be made by extrusion.

In certain embodiments, the heat-sink heat-dissipating surfaces include the surfaces of at least one edge-adjacent fin extending transversely from the beyond-module portion of the heat-sink base at a position beyond the venting apertures therealong. The venting apertures along the beyond-module portion may be spaced along the heat sink, which may be made by extrusion. In such embodiments, the beyond-module portion of the heat-sink base has at least one non-apertured portion extending thereacross to allow heat flow across the beyond-module portion toward the at least one edge-adjacent fin extending therefrom.

In some embodiments, the venting apertures along the beyond-module portion include two elongate apertures extending along the extrusion in spaced substantially end-to-end relationship. The at least one non-apertured portion may include a non-apertured portion which is between the two elongate apertures and is located substantially centrally along the length of the heat sink, which may be made by extrusion. In some of such embodiments, the combined length of the apertures along the beyond-module portion constitutes a majority of the length of the extrusion.

In certain embodiments, the heat-sink base includes a second beyond-module portion, the two beyond-module portions of the heat-sink base being along opposite sides of the module. In some of such embodiments, the at least one venting aperture also includes at least one venting aperture through the second beyond-module portion, and in some the at least one venting aperture includes at least two venting apertures along each of the beyond-module portions.

In some of such embodiments the surfaces of the at least one edge-adjacent fin extending transversely from each of the beyond-module portions are at positions beyond the venting apertures therealong. The venting apertures along each of the beyond-module portions of the heat-sink base may be spaced along the extrusion. Each of the beyond-module portions of the heat-sink base has at least one non-apertured portion extending thereacross to allow heat flow across such beyond-module portion toward the at least one edge-adjacent fin extending therefrom.

In some embodiments, the venting apertures along each one of the beyond-module portions include two elongate apertures extending along the extrusion in spaced substantially end-to-end relationship. The at least one non-apertured portion of each one of the beyond-module portions of the heat-sink base includes a non-apertured portion which is between the two elongate apertures and is located substantially centrally along the length of the extrusion. In some of such embodiments, the combined length of the apertures along each of the beyond-module portions constitutes a majority of the length of the extrusion.

In the embodiments where the heat-sink base includes a second beyond-module portion, the heat-sink base includes a module-engaging portion between the beyond-module portions. In some of such embodiments, the heat-sink heat-dissipating surfaces include the surfaces of a plurality of middle fins extending transversely from the module-engaging portion of the heat-sink base.

The edge-adjacent fins extending from each one of the beyond-module portions of the heat-sink base may be a single edge-adjacent fin, such two edge-adjacent fins forming the opposite lateral sides of the heat sink, which may be an extrusion. In some of such embodiments, the heat-sink base has a thickness at positions adjacent to the edge-adjacent fins that is greater than the thickness of the base at positions adjacent to some of the middle fins, thereby to facilitate conduction of heat laterally away from the module.

In certain embodiments, each of the edge-adjacent fins has a base-adjacent proximal portion integrally joined to the heat-sink base and a distal edge remote therefrom, the proximal portions of the edge-adjacent fins being thicker than the proximal portions of at least some of the middle fins, thereby to facilitate conduction of heat away from the module. The heat-sink base may have a thickness at positions adjacent to the edge-adjacent fins that is greater than the thickness of the base at positions adjacent to some of the middle fins, thereby to facilitate conduction of heat laterally away from the module.

In some embodiments, all of the fins extend away from the heat-sink base in a first direction. In some of such embodiments, the edge-adjacent fins also extend from the heat-sink base in a second direction opposite to the first direction to provide additional heat-dissipating surface. In such embodiments, the edge-adjacent fins and the heat-sink base may form an H-shaped structure.

In certain embodiments, the plurality of heat sinks are beside one another in positions such that the beyond-module portion of each of the heat sinks is adjacent to but spaced from the beyond-module portion of another of the heat sinks. Such arrangement further facilitates flow of cool air to the heat-dissipating surfaces of the heat sinks and thermal isolation of the heat sinks from one another.

In some of such embodiments, the spacing between the heat sinks is at least as great as the widths of the venting apertures in the beyond-module portions of the heat-sink bases.

Some embodiments of the inventive light fixture includes a housing and an LED assembly which includes the heat-sink-mounted LED-array modules. In some of such embodiments, the LED assembly and the housing form a venting gap therebetween to provide air ingress along the heat-sink base to the heat-dissipating surfaces.

The LED-array modules may be substantially rectangular elongate modules. Examples of LED-array modules are disclosed in co-owned U.S. Pat. No. 7,938,558, the contents of which are incorporated herein by reference.

The LED assembly may include a plurality of heat sinks each with its own heat-dissipating surfaces and heat-sink base. In some of such embodiments, each heat-sink base has one of the LED-array modules engaged thereon, the base being wider than the module thereon such that the heat-sink base includes a beyond-module portion. In such embodiments, the at least one venting aperture includes at least one venting aperture through the beyond-module portion of the heat-sink base.

Another aspect of this invention is a mounting assembly which includes a bar having a gripping region and a gripper grips the gripping region such that the light fixture is held with respect to the static structure. The bar has a first end secured with respect to one of the static structure and a main body portion of the light fixture. The gripper is attachable to the other of the static structure and the main body portion of the light fixture.

In certain embodiments the mounting assembly it is not adjustable. The bar may have a cross-sectional shape which is gripped by the gripper such that the fixture is held in only one orientation. Such cross-sectional shape of the bar may include rectangular shapes such as square.

In some embodiments, the inventive mounting assembly facilitates adjustment of the light fixture to a selected one plurality of possible orientations during installation. In some of such embodiments, the gripper grips the gripping region such that the light fixture is held in a selected one of the plurality of possible orientations.

In some embodiments, the first end of the bar is secured with respect to the main body portion of the light fixture. In such embodiments, the gripper is attachable to the static structure.

In certain embodiments of the adjustable mounting assembly, the gripper and the bar may be configured for a finite number of the orientations. The mounting assembly of some of such embodiments further includes a guide indicating the angle for each of the orientations of the light fixture with respect to the static structure.

The guide may be a bracket removably secured with respect to the bar at a plurality of positions therealong. In some embodiments, the bracket is shaped to follow the outer shape of the bar and includes angle markings, and the gripper has a reference line which points to a particular one of the angle markings indicating the angle of the light fixture with respect to the static structure.

The bar also has a second end opposite the first end. In some embodiments, the second end may also be secured with respect to the main body portion; in such embodiments, the gripping region is between the first and second ends and is spaced from the main body portion. In some of such embodiments, the gripper-bar orientations include a number of positions of the gripper along the bar.

In some embodiments, the bar defines a plurality of positions for securing the bracket therealong.

The mounting assembly of the present invention may further include at least one bar support that projects from the main body portion. In such embodiments, the first end of the bar is supported by the bar support such that the gripping region is along and spaced from the main body portion. The bar support may include a bar-support portion engaged with the first end of the bar. In some embodiments, the bar is hollow. In such embodiments, the bar-support portion is inserted into the first end of the bar. The bar interior and the bar-support portion preferably shaped to prevent relative rotation.

In certain embodiments, the gripper includes first and second bar-engaging portions facing one another with the bar therebetween. The bar is preferably substantially cylindrical. In such embodiments, each of the bar-engaging portions has a semi-cylindrical bar-engaging surface. The semi-cylindrical bar-engaging portions together encircle and engaging the bar.

The gripper and the bar are configured for a finite number of orientations. The gripping region and the gripper preferably have anti-rotational interlocking features complementary to one another such that, when the anti-rotational interlocking features of the bar-engaging portions are interlocked with the interlocking features of the bar, the light fixture is held in a selected one of a finite plurality of orientations. The anti-rotational interlocking features may include parallel inter-engaged flutes and grooves along the gripping region of the bar and the gripper. The bar may be made by extrusion, e.g., of a suitable metal such as aluminum or tough, rigid, structural polymeric material.

The first bar-engaging portion may be configured for securement with respect to the static structure and the second bar-engagement portion be configured for attachment to the first bar-engagement portion with the bar sandwiched therebetween. In some versions, the first bar-engaging portion is configured for attachment atop a light pole.

Yet another aspect of the present invention is a light fixture including the main body portion and the mounting assembly for adjustable securement to a static structure such that, when the anti-rotational interlocking features of the bar-engaging portions are interlocked with the interlocking features of the bar, the light fixture is held in a selected one of a finite plurality of orientations.

As used herein in referring to portions of the devices of this invention, the terms "upward," "upwardly," "upper," "downward," "downwardly," "lower," "upper," "top," "bottom" and other like terms assume that the light fixture is in its usual position of use.

In descriptions of this invention, including in the claims below, the terms "comprising," "including" and "having" (each in their various forms) and the term "with" are each to be understood as being open-ended, rather than limiting, terms.

BRIEF DESCRIPTION OF THE DRAWINGS

FIG. 23 is a perspective view of the mounting assembly of the light fixture of FIG. 21 with removed cover assembly and showing a terminal block being inserted into a pole-connector enclosure.

FIG. 24 is a fragmentary perspective view of the LED light fixture as in FIG. 21 in a position for installation atop a round tenon.

DETAILED DESCRIPTION OF PREFERRED EMBODIMENTS

Figure 1:
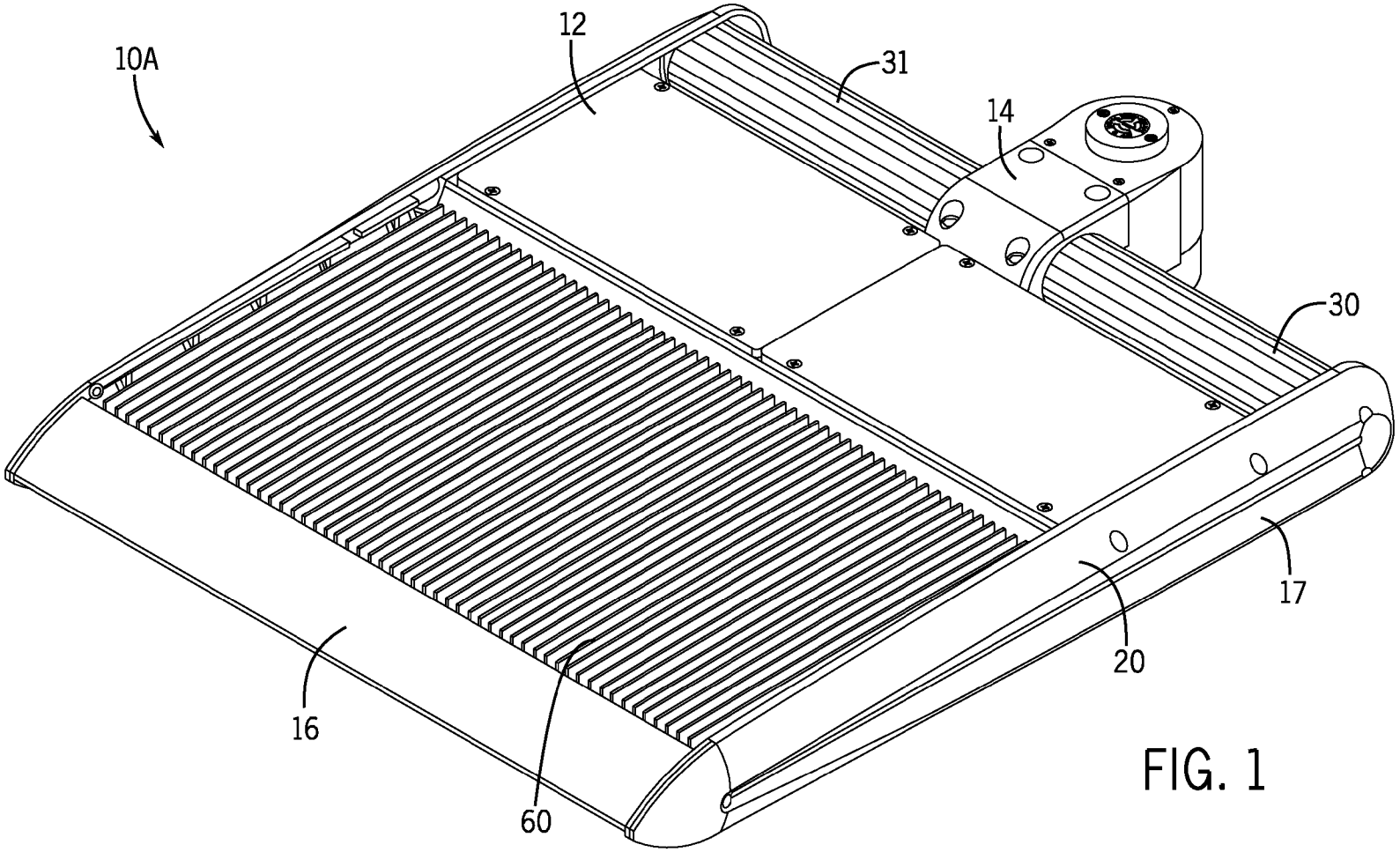
FIG. 1 is a top perspective view of one embodiment of an LED light fixture in accordance with this invention.

FIGS. 1-11 illustrate an LED light fixtures 10A and 10B (the latter in FIG. 2 only) in accordance with this invention. Common or similar parts are given the same numbers in the drawings of both embodiments, and the light fixtures are often referred to by the numeral 10, without the A or B lettering used in the drawings, and in the singular for convenience.

Figure 2:
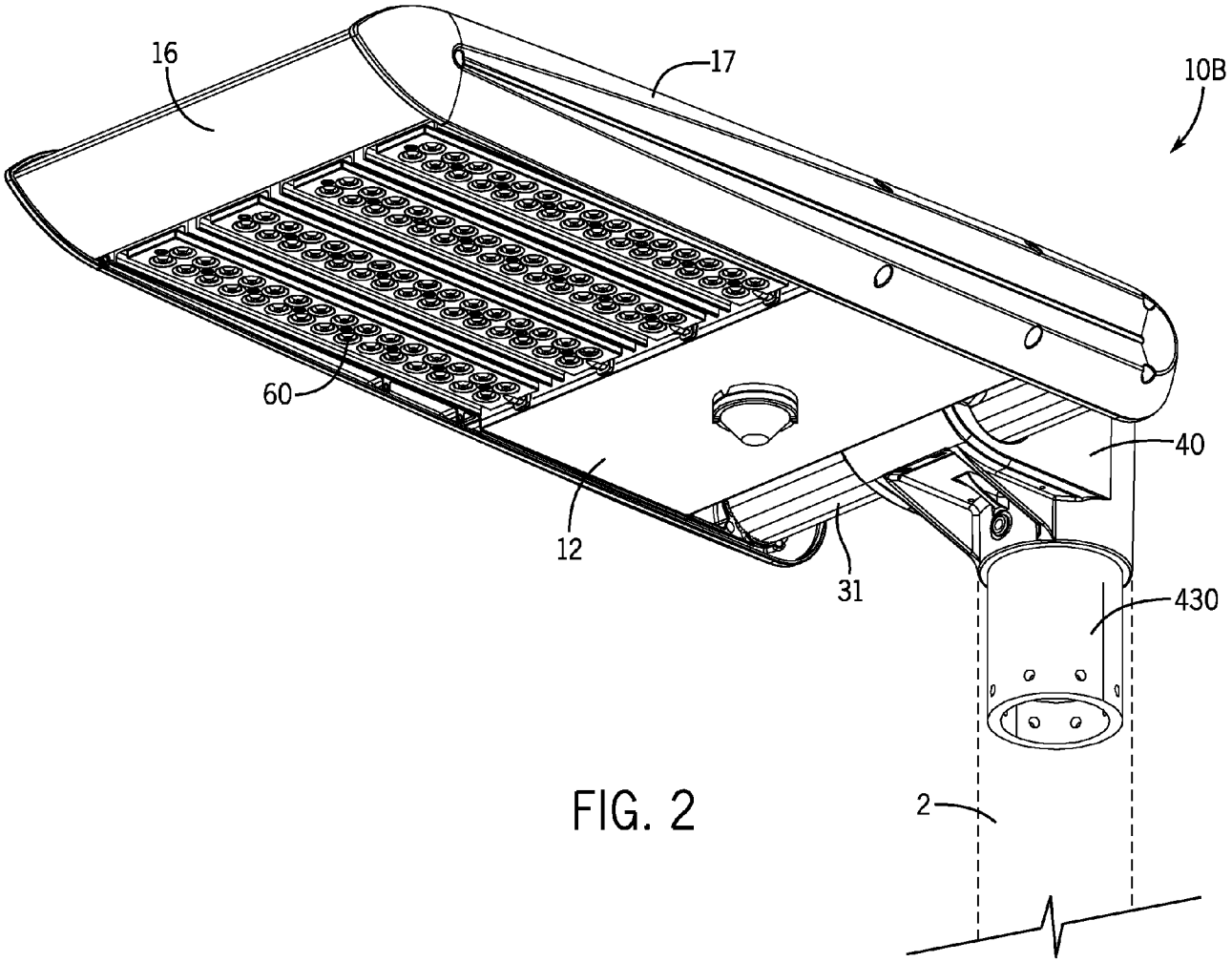
FIG. 2 is a bottom perspective view of another embodiment of an LED light fixture in accordance with this invention, and including fewer LED modules than the embodiment of FIG. 1.
Figure 3:
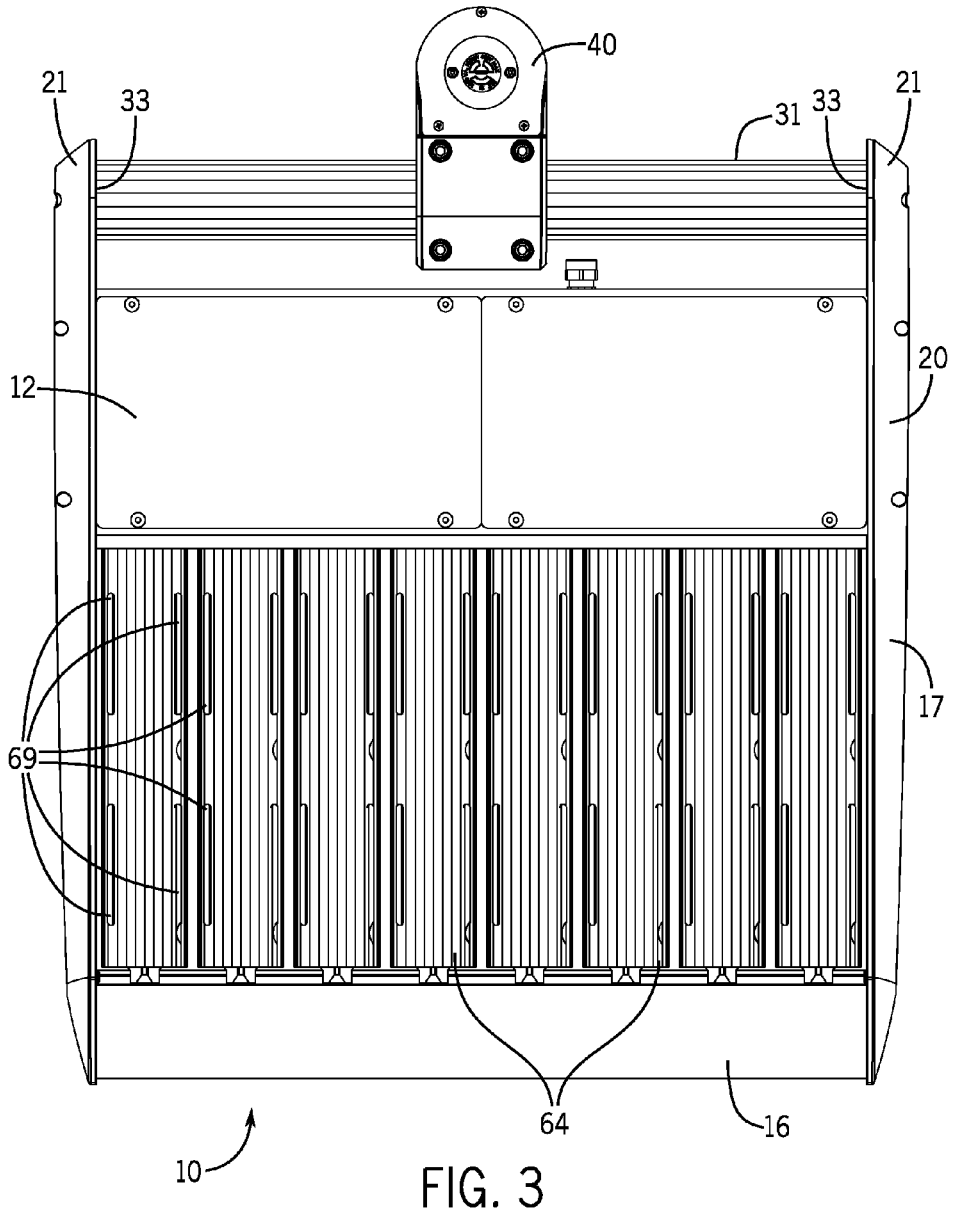
FIG. 3 is a top plan view of the LED light fixture of FIG. 1.
Figure 4:
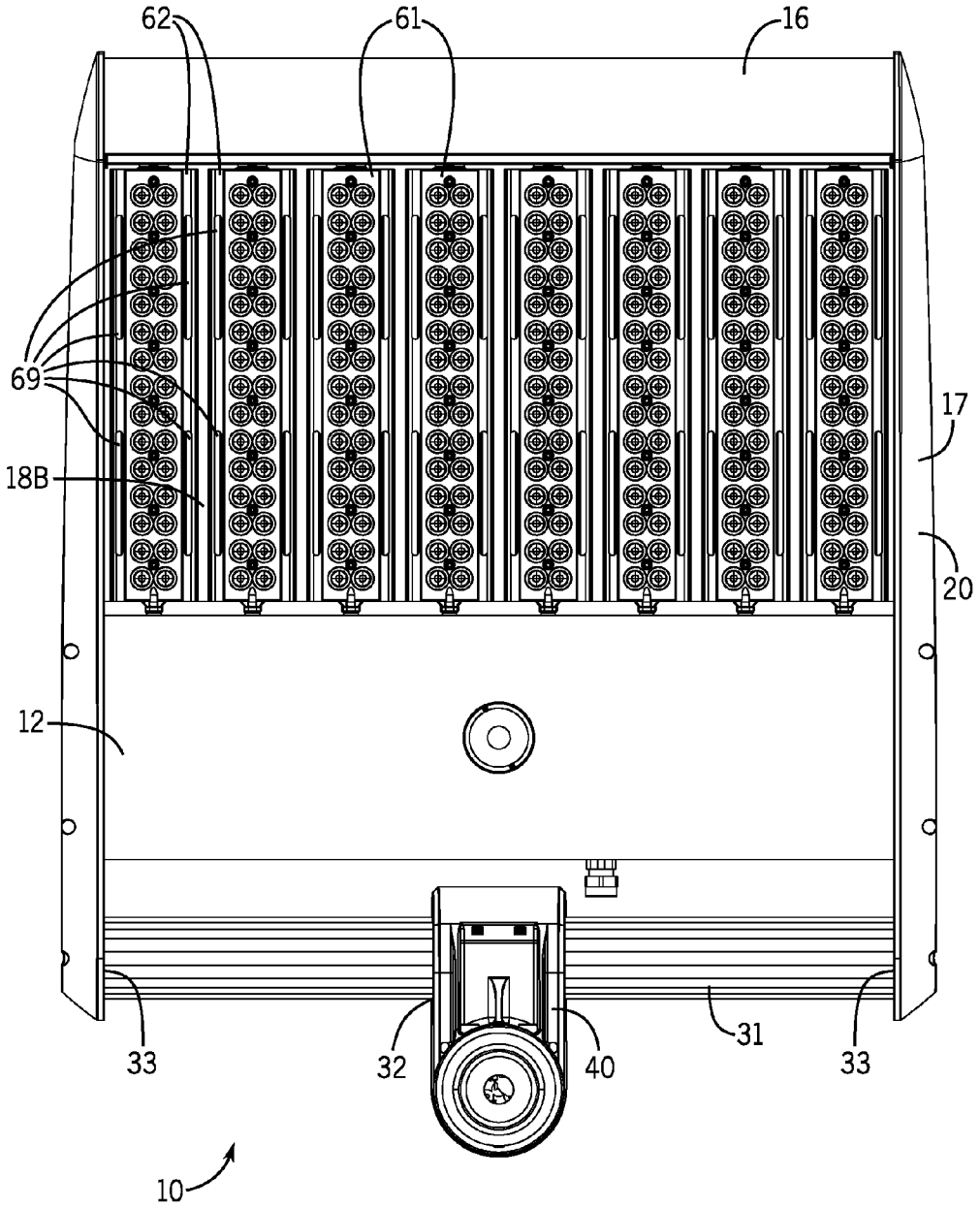
FIG. 4 is a bottom plan view of the LED light fixture of FIG. 1.

FIGS. 1-4 show that light fixture 10 including an LED assembly 60 which is open to air/water flow thereover. As seen in FIGS. 2 and 4, LED assembly 60 has a plurality of LED-array modules 61 each secured to an individual LED heat sink 62 (best seen in FIG. 3) which has first and second heat-sink ends 63 and 64 best seen in FIG. 5.

Figure 13:
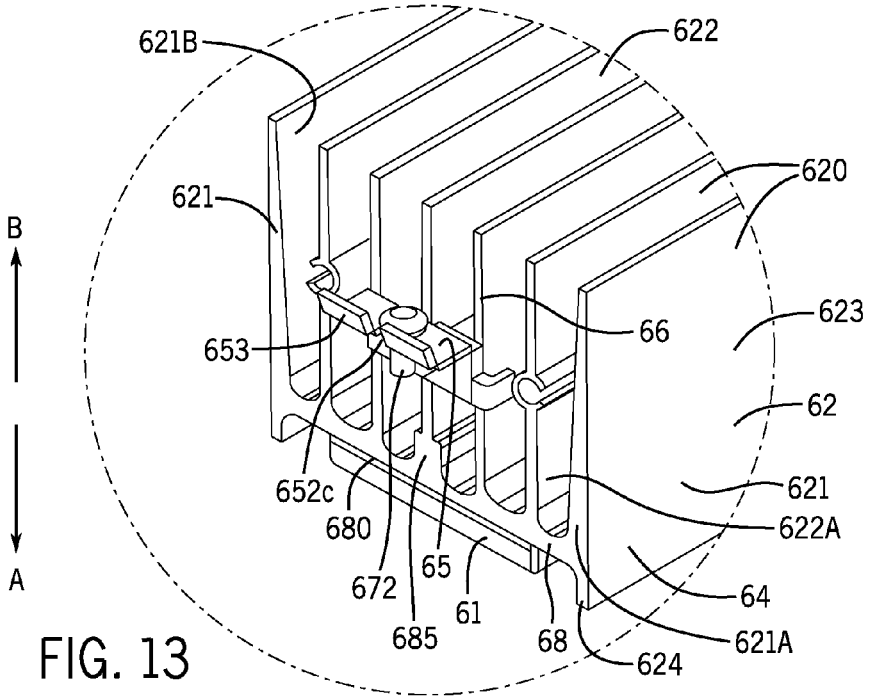
FIG. 13 is a fragmentary perspective view of one LED heat sink illustrating a mounting clip shown in FIG. 12 and seen in FIG. 5.

It is seen in FIGS. 2 and 4 that LED light fixture 10 includes a plurality of heat-sink-mounted LED-array modules 61. Each module 61 engages an LED-adjacent surface 680 of heat-sink base 68 for transfer of heat from module 61. Heat-sink heat-dissipating surfaces include fins 620 which extend away from modules 61, as seen in FIG. 13. Each heat-sink base 68 is wider than module 61 thereon such that heat-sink base 68 includes a beyond-module portion 681.

Figure 17:
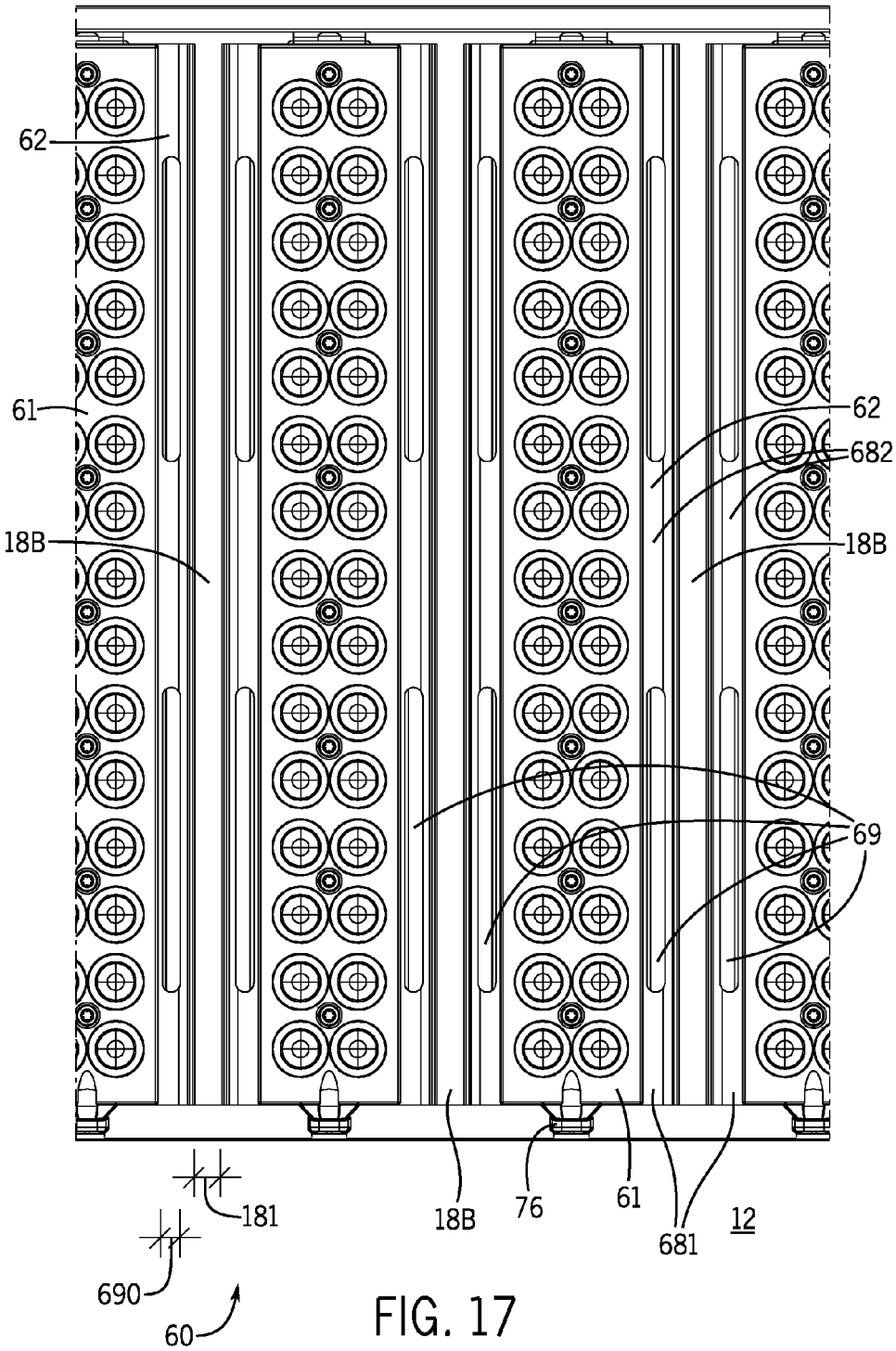
FIG. 17 is a fragmentary bottom plan view of the LED assembly shown in FIG. 4 and illustrating in more detail air-flow channels facilitating heat dissipation from LEDs.

It is further seen in FIG. 17 that each heat sink 62 has venting apertures 69 formed through heat-sink base 68 to provide cool-air ingress to and along heat-dissipating fins 620 by upward flow of heated air therefrom. FIGS. 4 and 17 also show venting apertures 69 is through beyond-module portion 681 of heat-sink base 68.

Heat-sink heat-dissipating surfaces include the surfaces of edge-adjacent fins 621 extending transversely from beyond-module portion 681 of heat-sink base 68 at a position beyond venting apertures 69 therealong. As best seen in FIG. 17, venting apertures 69 along beyond-module portion 681 are spaced along heat sink 62, which may be an extrusion. Beyond-module portion 681 of heat-sink base 68 has a non-apertured portion 682 extending thereacross to allow heat flow across beyond-module portion 681 toward edge-adjacent fin 621 extending therefrom.

FIGS. 4 and 17 further show two venting apertures 69 along beyond-module portion 681 extending along heat sink 62 in spaced substantially end-to-end relationship. Non-apertured portion 682 include a non-apertured portion which is between two elongate apertures 69 and is located substantially centrally along the length of heat sink 62. The combined length of apertures 69 along beyond-module portion 681 constitutes a majority of the length of heat sink 62, as seen in FIG. 17.

Heat-sink base 68 includes a module-engaging portion 685 between beyond-module portions 681. Heat-sink heat-dissipating surfaces include the surfaces of a plurality of middle fins 622 extending transversely from module-engaging portion 685 of heat-sink base 68, as seen in FIG. 13.

As also seen in FIG. 13, edge-adjacent fins 621 extending from each one of beyond-module portions 681 of heat-sink base 68 are each a single edge-adjacent fin. Such two edge-adjacent fins 621 form opposite lateral sides 623 of heat sink 62. Heat-sink base 68 has a thickness at positions adjacent to edge-adjacent fins 621 that is greater than thickness of base 68 at positions adjacent to some of middle fins 622, thereby to facilitate conduction of heat laterally away from module 61.

It is seen in FIG. 13 that side fins 621 edge-adjacent fins 621 has a base-adjacent proximal portion 621A integrally joined to heat-sink base 68 and a distal edge 621B remote therefrom. Proximal portions 621A of edge-adjacent fins 621 are thicker than proximal portions 622A of at least some of middle fins 622, thereby to facilitate conduction of heat away from module 61.

Fins 621 and 622 extend away from heat-sink base 68 in a first direction B. Edge-adjacent fins 621 also extend from heat-sink base 68 in a second direction A opposite to first direction B to provide additional heat-dissipating surface 624. Edge-adjacent fins 621 and heat-sink base 68 are shown to form an H-shaped structure seen in FIG. 13.

Figure 18:
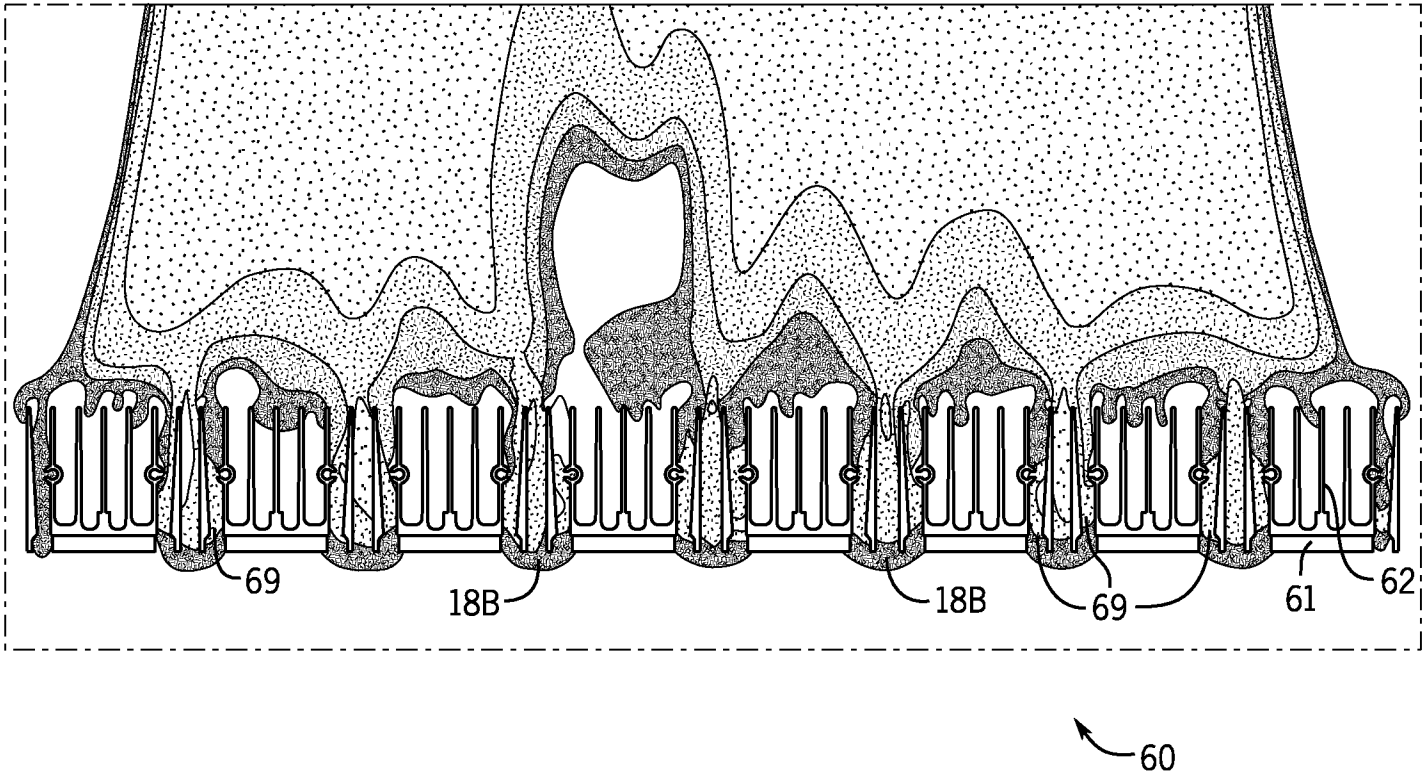
FIG. 18 is a fragmentary sectional view across the LED assembly of FIG. 17 illustrating simulated air-flow velocity through the channels.

It is seen in FIGS. 3, 4 and 17 that fixture 10 also has air gaps 18B defined between adjacent pairs of heat sinks 62 to provide heat removal along entire length of each heat sink 62 by cool air drawn from below LED assembly 60 through air gaps 18B by rising heated air. FIGS. 3, 4, 17 and 18 show the plurality of heat sinks 62 beside one another in positions such that beyond-module portion 681 of each of heat sinks 62 is adjacent to but spaced from beyond-module portion 681 of another of heat sinks 62. As illustrated in FIG. 18, such arrangement further facilitates flow of cool air to the heat-dissipating surfaces of heat sinks 62 and thermal isolation of the heat sinks 62 from one another.

As seen in FIG. 17, spacing 181 between heat sinks 62 is at least as great as widths 690 of venting apertures 69 in beyond-module portions 681 of heat-sink bases 68.

Figure 11:
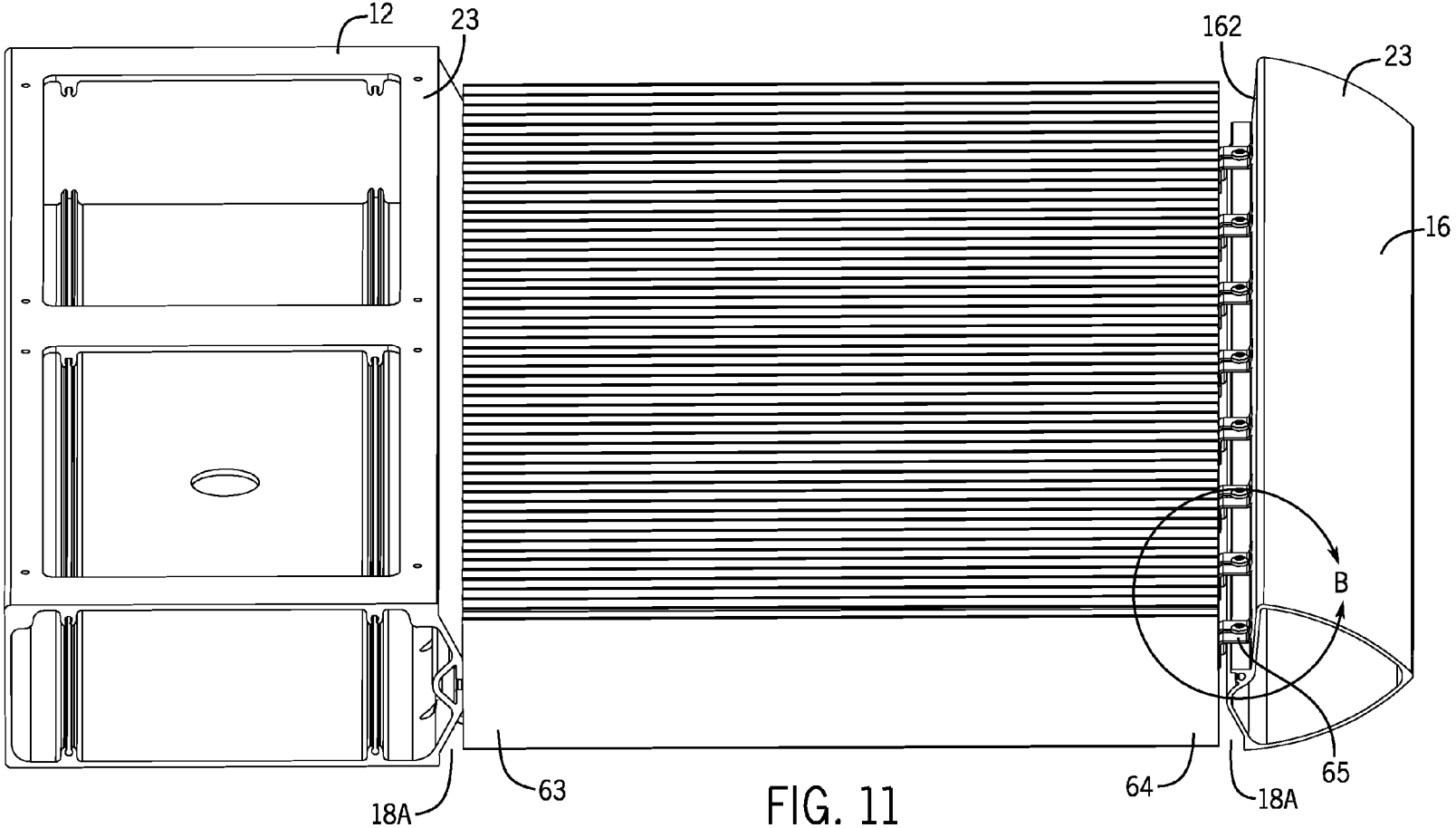
FIG. 11 is a fragmentary sectional perspective view illustrating mounting of LED heat sinks of the LED assembly of the light fixture of FIG. 1.
Figure 14:
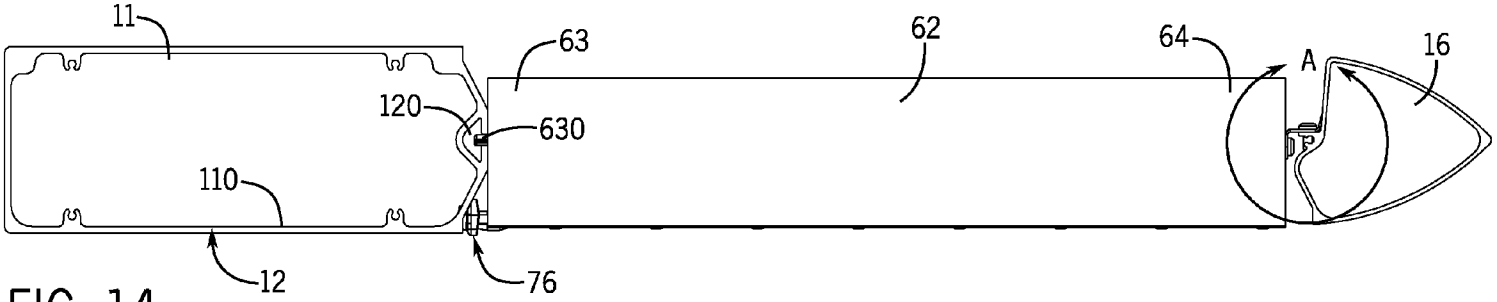
FIG. 14 is a sectional side view of the mounting of LED heat sinks, as shown in FIG. 11.

Light fixture 10 includes a housing 23 with LED assembly 60 secured with respect thereto such that LED assembly 60 and housing 23 form a venting gap 18A therebetween to provide air ingress along heat-sink base 68 to the heat-dissipating surfaces. As seen in FIGS. 11 and 14, air gaps 18A are along first and second heat sink ends 63 and 64 permitting air/water-flow to and from heat sinks 62 through heat sink ends 63 and 64.

FIG. 18 shows simulated velocity of air flow along LED assembly 60. The darker areas between heat sinks 62 and through venting apertures 69 illustrates increased air flow which facilitates heat removal from LED assembly 60. Modules 61 are shown as substantially rectangular elongate LED-array modules with a plurality of LED positioned on a circuit board which is secured to the heat sink.

Examples of LED-array modules are disclosed in co-pending U.S. patent application Ser. No. 11/774,422, the contents of which are incorporated herein by reference. In fixtures utilizing a plurality of emitters, a plurality of LEDs or LED arrays may be disposed directly on a common submount in spaced relationship between the LEDs or LED arrays. These types of LED emitters are sometimes referred to as chip-on-board LEDs.

The above-described thermal management of the LED light fixture including venting gaps 18A, 18B and through heat sink venting apertures 69 allows to maximize power density of LEDs on the printed circuit board to 4.9 W per square inch. This is in contrast to prior fixtures limited to 3.2 W per square inch. In the inventive light fixture, the LED junction temperature and resulting lifetime of the LEDs is improved even at the higher power density which results in a 50,000 hour lumen maintenance factor of a minimum of 86% at 15° C.

Furthermore, the inventive thermal management of the LED light fixture allows each heat sink to function in thermal isolation from neighboring heat sinks which minimizes thermal compromise with increasing the number of heat sinks in the modular LED light fixture as fixture 10 shown in the drawings. In the fixture according to the present invention, a number lumens delivered per unit area of the modular LED assembly (sometimes referred to as "light engine") is increased from previously possible 95 lumens per square inch to over 162 lumens per square inch. This is allowed by the inventive thermal management of the LED light fixture.

This is in contrast with prior modular fixtures in which due to the thermal interference between adjacent heat sinks, an increase the number of light engine heat sinks resulted in a decrease in lumen flux to as low as 56 lumens per square inch.

It is further seen in FIGS. 1-4 that LED assembly 60 is bordered by driver housing 12 and a nose structure 16 each along one of opposite heat-sink ends 63 and 64, and that driver housing 12 and nose structure 16 are secured with respect to one another by a frame portion 17 extending alongside LED assembly 60.

Figure 12:
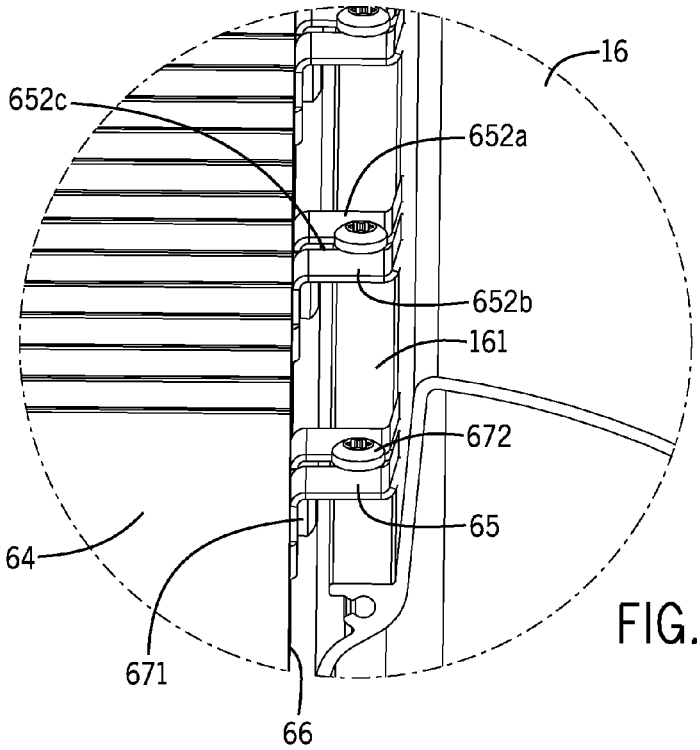
FIG. 12 is a fragmentary perspective view of the mounting engagement of one end of the LED heat sinks, as shown in FIG. 11.
Figure 16:
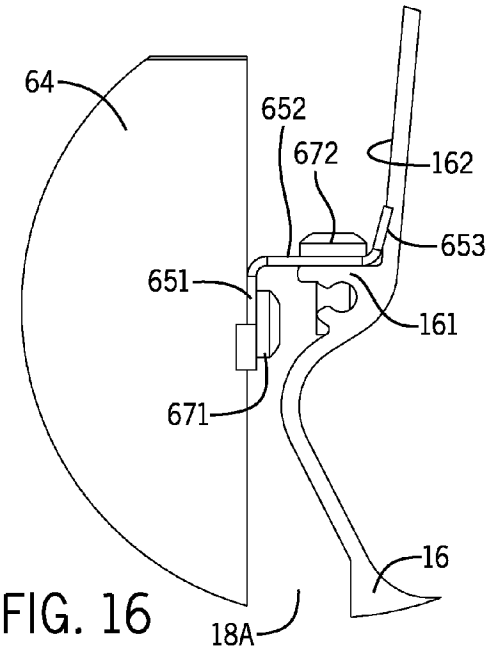
FIG. 16 is a fragmentary sectional side view of the mounting clip holding the end of the LED heat sink, as shown in FIG. 14.
Figure 15:
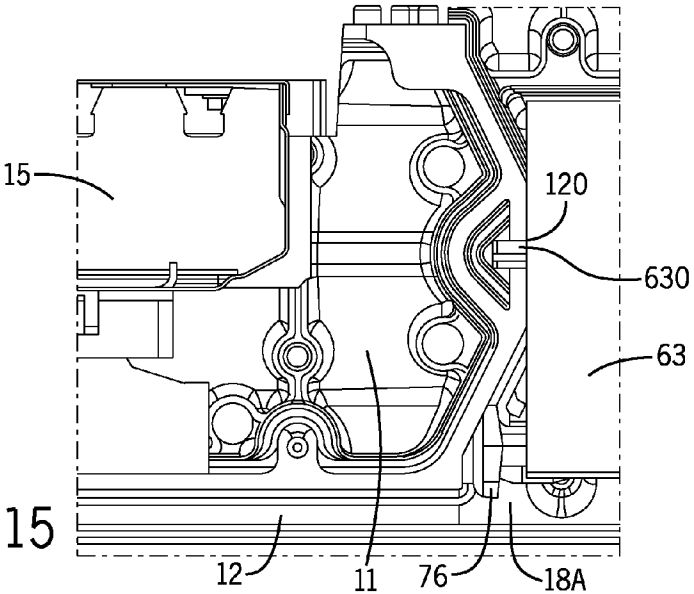
FIG. 15 is a fragmentary sectional side view of the mounting engagement of the other end of the LED heat sinks, as shown in FIGS. 11 and 14.

FIGS. 11-16 illustrate an engagement of first heat-sink end 63 with driver housing 12 and a securement of second heat-sink end 64 to nose structure 16. It is best seen in FIGS. 14 and 15 that first heat-sink end 63 includes a pin 630 extending therefrom and inserted into a slot 120 formed along driver housing 12. FIGS. 11-14 and 16 show second heat-sink end 64 secured with respect to nose structure 16 with a spring clip 65. FIGS. 12, 13 and 16 show clip 65 formed from a sheet metal bent into first, second and third clip portions 651, 652 and 653. First clip portion 651 is attached to a substantially vertical fin edge 66 of second heat-sink end 64 with a fastener 671. Second clip portion 652 is substantially orthogonal to first clip portion 651 and has two subportions 652*a* and 652*b* with an opening 652*c* therebetween. Second clip portion 652 is attached to a substantially horizontal shelf 161 formed along nose structure 16 with a fastener 672 extending through opening 652*c* and pressing second clip subportions 652*a* and 652*b* against self 161. Third clip portion 653 extends from second clip portion 652 toward a surface 162 of nose structure 16 and extending transversely to shelf 161. Third clip portion 653 presses against surface 162 and by its spring action pushes pin 630 of first heat-sink end 63 into slot 102 for secure holding of heat sink 62 within fixture 10 and provides a positive seal on a light-module grommet 760. FIGS. 11 and 12 further show that each of the plurality of heat sinks 62 is individually secured with respect to driver housing 12 and nose structure 16 in the above-described manner.

Light fixture 10 includes a main body portion 20 and a mounting assembly 30 for adjustable securement to a static structure. An exemplary static structure is shown in FIG. 2 as a pole 12 atop which fixture 10 may be installed. It should be understood, of course, that the inventive light fixture 10 may be mounted with respect to other static structures such as walls, ceilings, along-ground mounts, free-standing advertizing frames and the like.

Figure 6A:
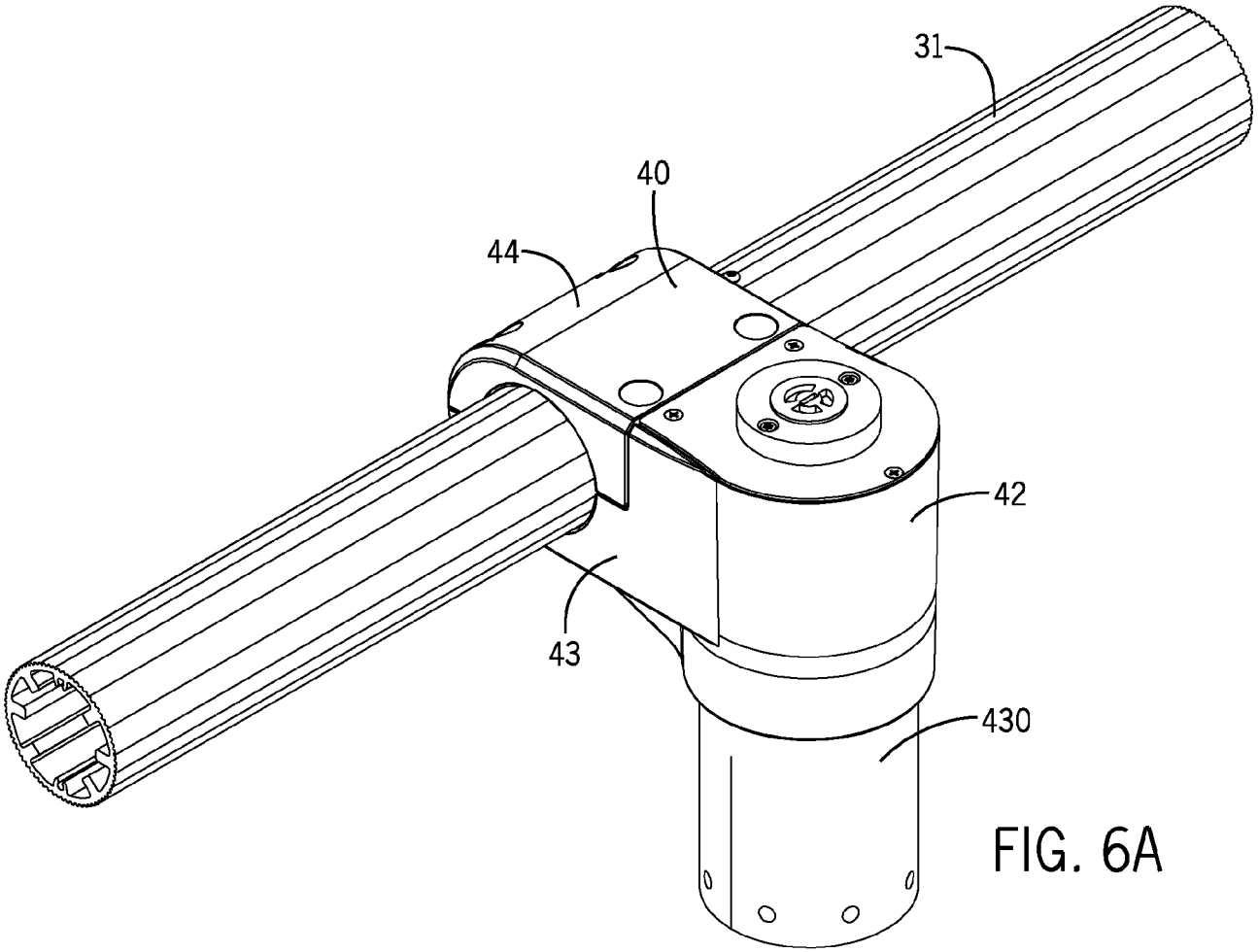
FIG. 6A is a top perspective view of a mounting assembly in accordance with the present invention.
Figure 6B:
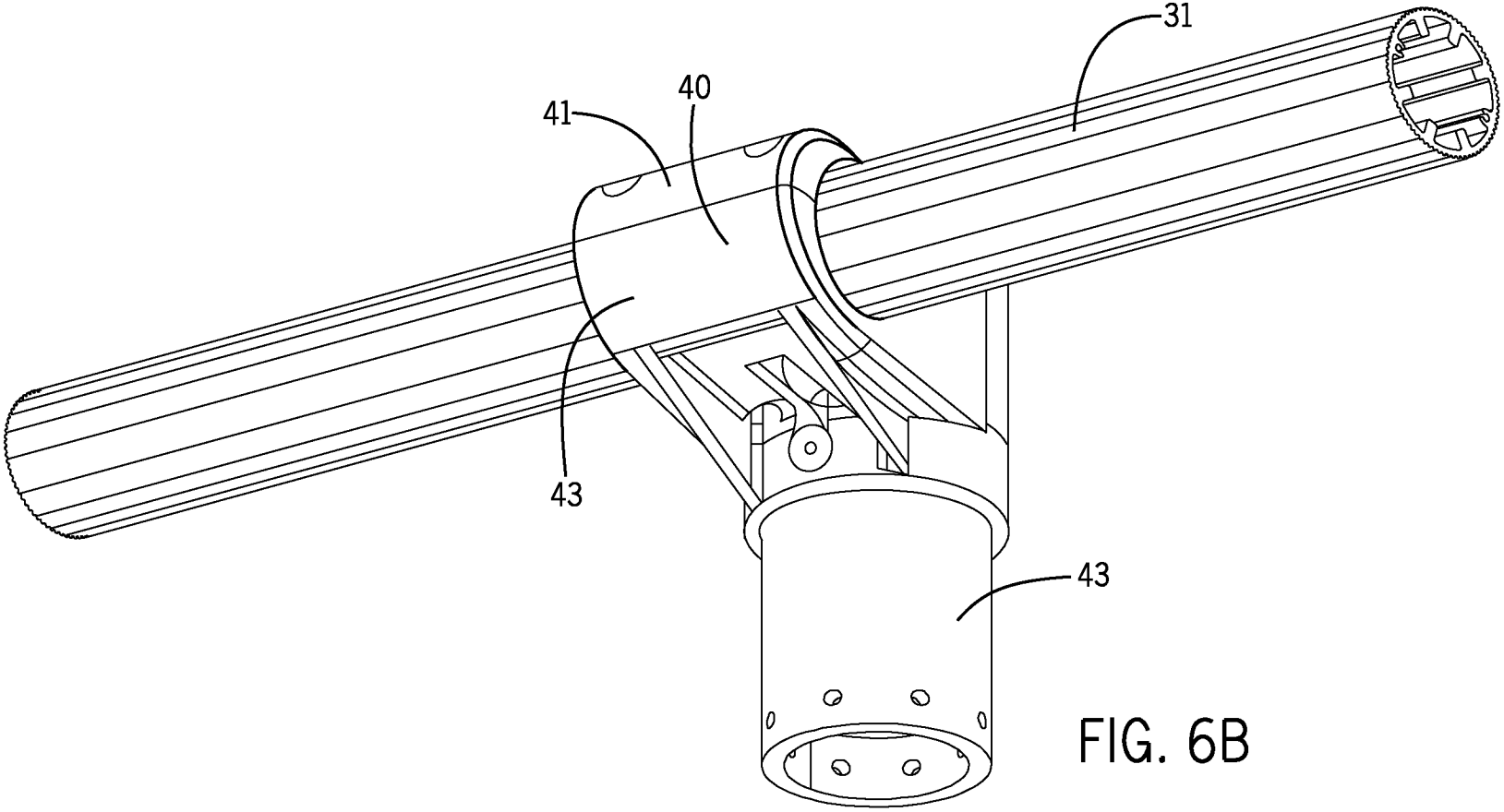
FIG. 6B is a bottom perspective view of the mounting assembly of FIG. 6A.
Figure 7:
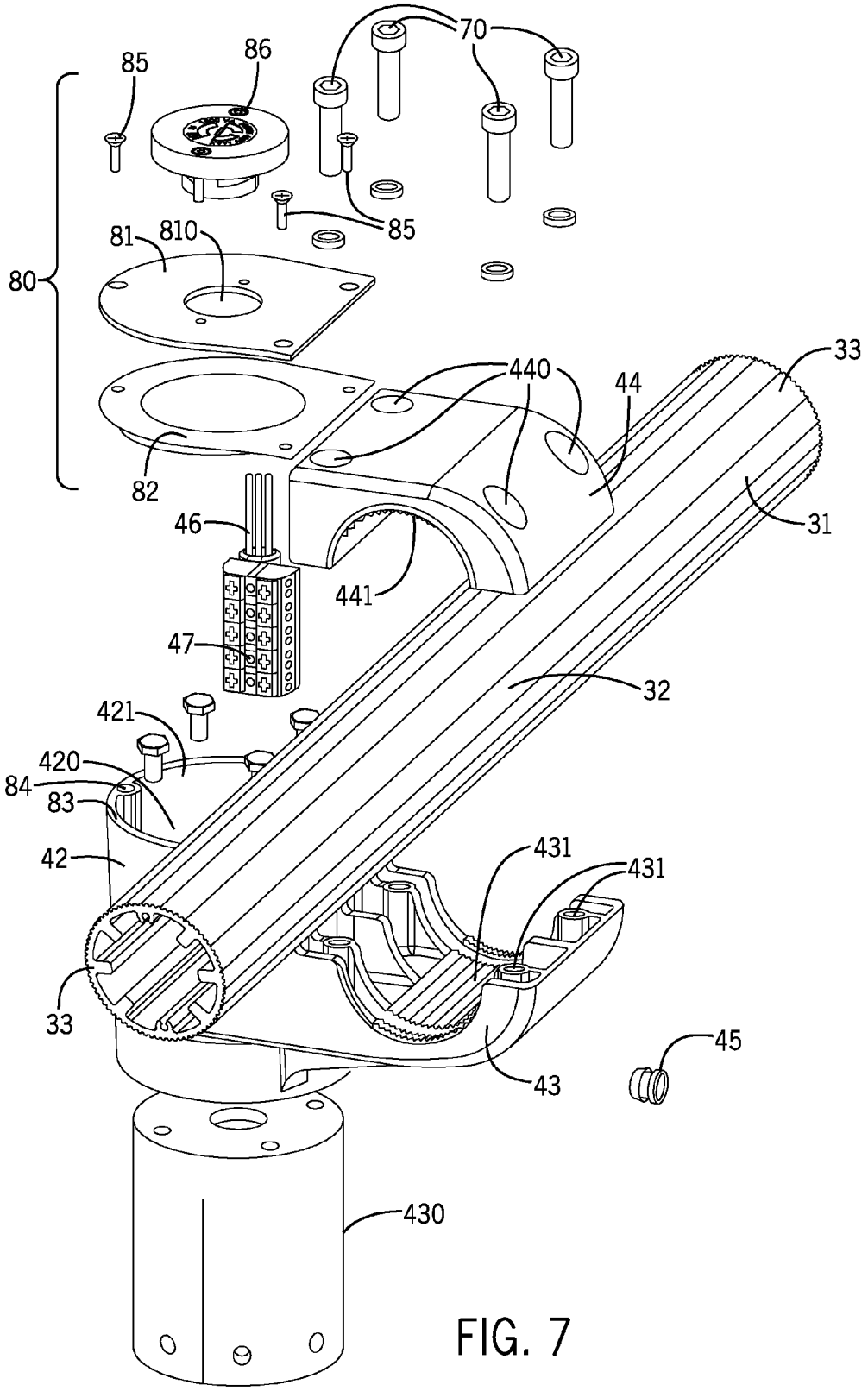
FIG. 7 is an exploded perspective view of the mounting assembly of FIG. 6A.

Mounting assembly 30 illustrated in FIGS. 1-10 includes a bar 31 having a gripping region 32 and a gripper 40 attachable to pole 12. As best seen in FIGS. 6-7, gripper 40 grips gripping region 32 such that light fixture 10 is held in a selected one of a plurality of orientations. In the illustrated embodiment, bar 31 has first and second opposite ends 33 secured with respect to main body portion 20 of light fixture 10. FIGS. 3 and 4 best show gripping region 32 being between first and second ends 33 and spaced from main body portion 20.

Figure 10:
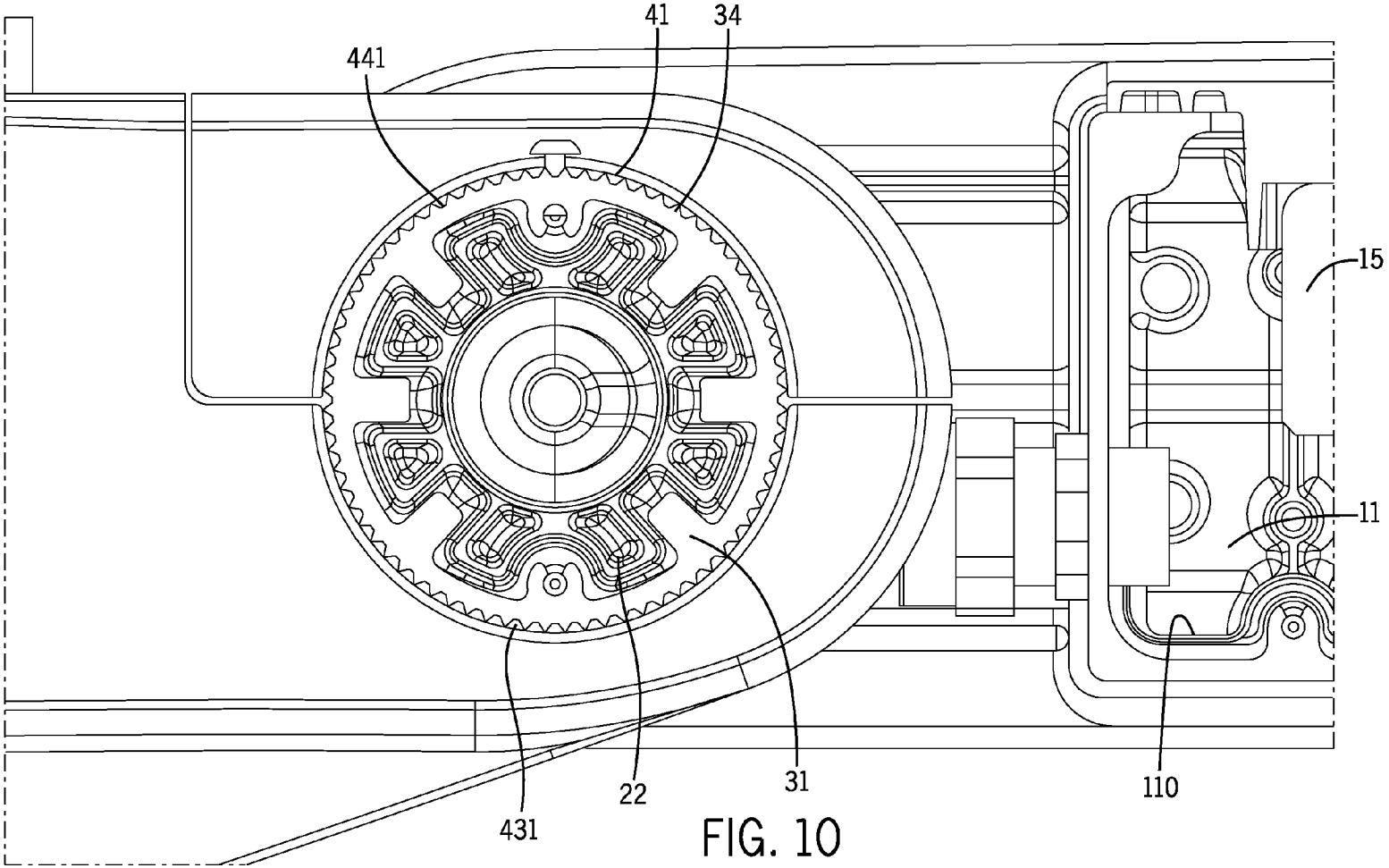
FIG. 10 is a fragmentary sectional view showing the bar-support portion inside the bar interior and illustrating their engagement preventing relative rotation.

In FIGS. 1-5, a pair of bar supports 21 are shown projecting from main body portion 20. FIGS. 3 and 4 best illustrate that first and ends 33 of bar 31 are each supported by one of the bar supports 21 such that gripping region 32 is along and spaced from main body portion 20. FIGS. 5 and 8-10 show each bar support 21 including a bar-support portion 22 engaged with end 33 of bar 31. In FIGS. 5-8, bar 31 is shown hollow. FIG. 10 best illustrates bar-support portion 22 inserted into end 33 of bar 31. As further seen in FIGS. 8-10, bar interior 36 and bar-support portion 22 are each shaped to prevent relative rotation.

Figure 8:
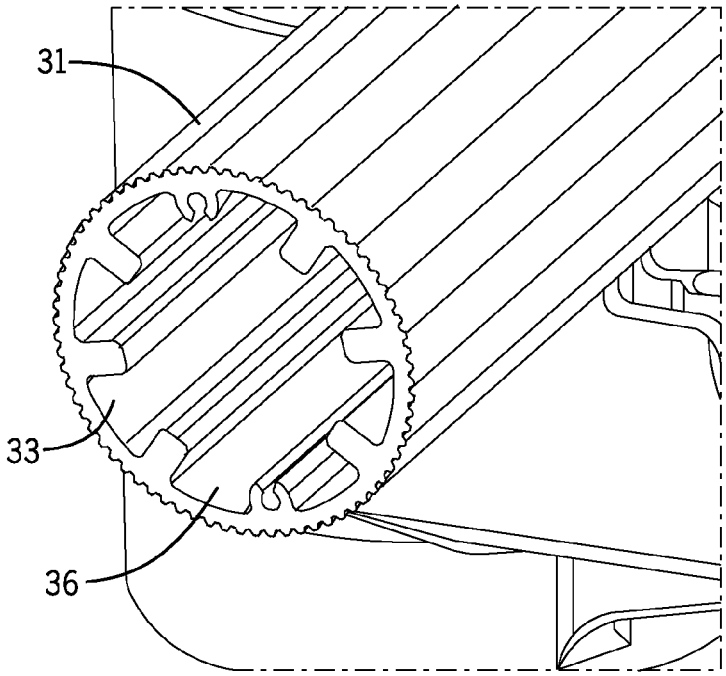
FIG. 8 is a fragmentary view of a bar and illustrating the bar interior.
Figure 9:
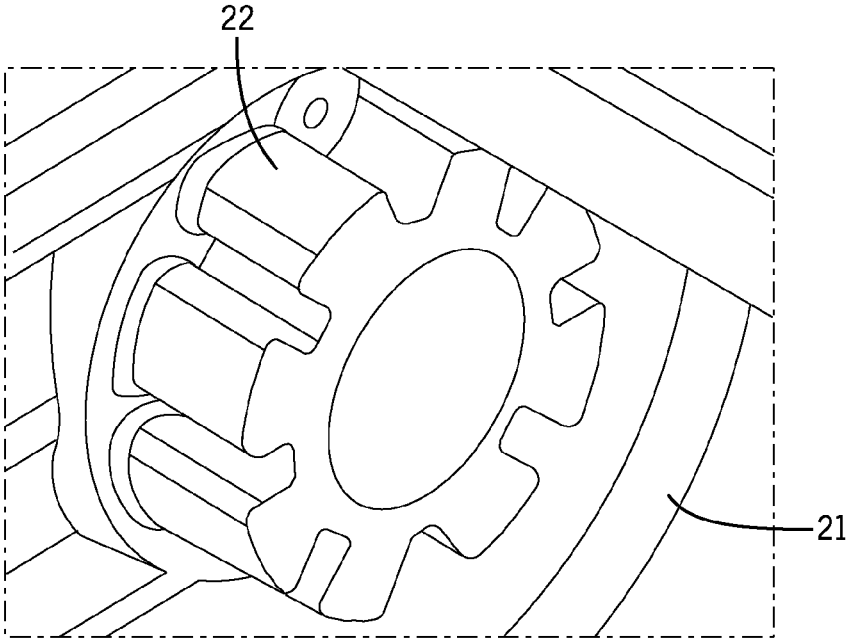
FIG. 9 is a fragmentary view of a bar-support portion shaped for insertion into the bar interior.

In FIGS. 6-8, bar 31 is shown as substantially cylindrical extruded piece.

FIGS. 6A and 6B best illustrate gripper 40 including a first bar-engaging portion 43 and a second bar-engaging portion 44 facing one another with bar 31 sandwiched therebetween. FIG. 7 best shows that each of bar-engaging portions 43 and 44 has a semi-cylindrical bar-engaging surface 431 and 441, respectively. Semi-cylindrical bar-engaging portions 43 and 44 together encircle and engaging bar 31.

Bar-engaging surfaces 431 and 441 of gripper 40 and gripping region 32 of bar 31 are configured for a finite number of the orientations. As seen in FIGS. 7 and 10, gripping region 32 of bar 31 has parallel inter-engaged flutes and grooves 34 which are complementary to flutes and grooves 41 along bar-engaging surfaces 431 and 441 of gripper 40. These complementary flutes and grooves 34 and 41 also serve as anti-rotational interlocking features between bar 31 and gripper 40 which when interlocked hold light fixture 10 in a selected one of the finite plurality of orientations.

Figure 22:
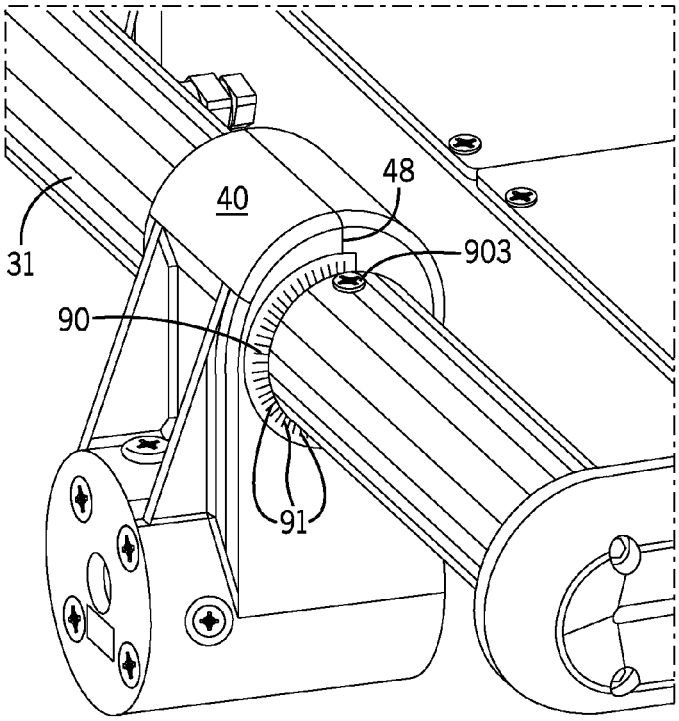
FIG. 22 is an enlarged portion of FIG. 21 showing details of the bracket.
Figure 25:
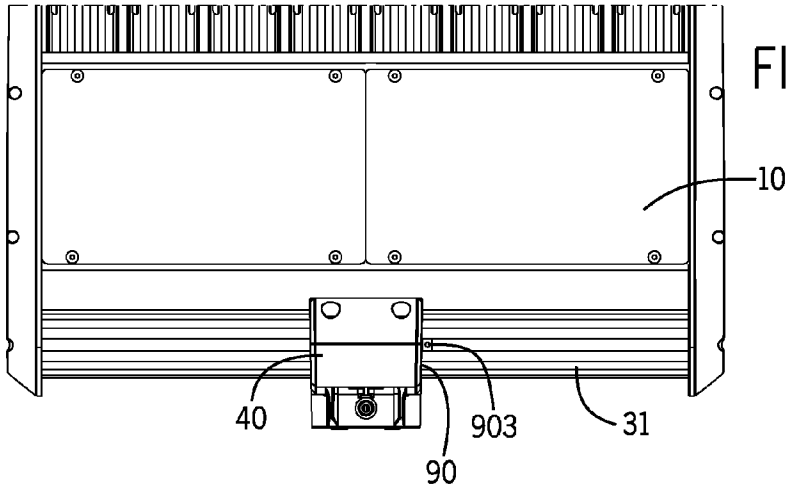
FIG. 25 is a fragmentary top plan view of the LED light fixture of FIG. 21.
Figure 26:
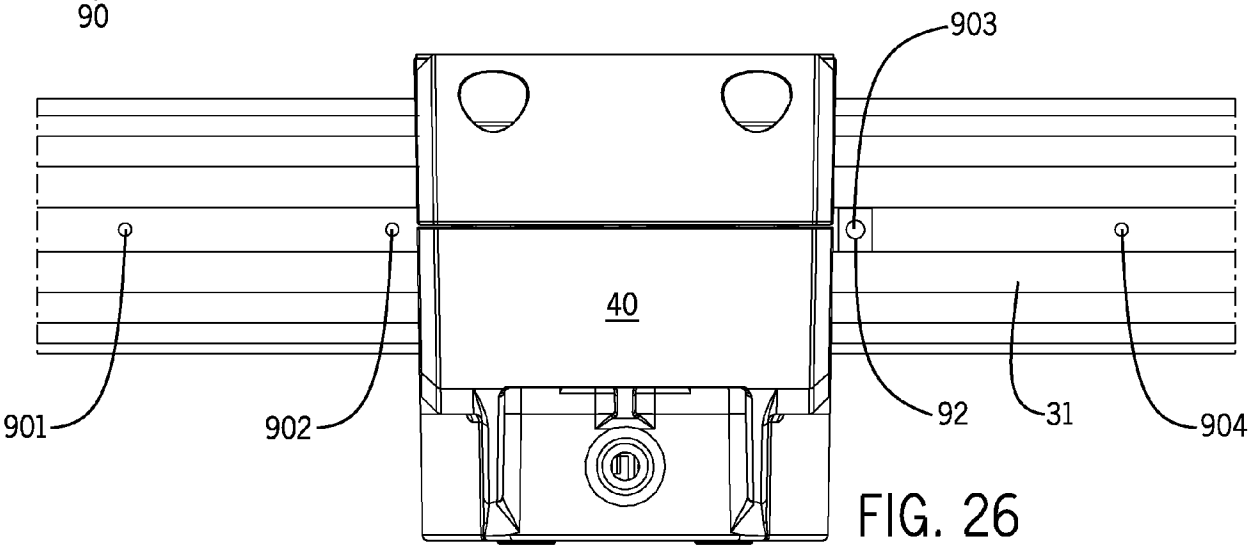
FIG. 26 is an enlarged portion of FIG. 25 showing details of the bar.

FIGS. 21-26 illustrate mounting assembly 30 including a guide which indicates the angle for each of the orientations of light fixture 10 with respect to the static structure. These figures show the guide in the form of a bracket 90 which is removably secured with respect to bar 31. FIGS. 25 and 26 show positions 901, 902, 903 and 904 along the bar at which bracket 90 may be secured. FIG. 26 shows these positions in the form of apertures defined by bar 31. It is also seen in FIGS. 25 and 26 that bracket 90 includes a flange 92 for each of the apertures. Flange 92 defines a hole aligned with the corresponding aperture and receives a fastener therethrough for securing bracket 90 to bar 31. In FIGS. 25 and 26, bracket 90 is secured at position 903. In FIGS. 23 and 24, bracket 90 is secured at position 902. As seen in FIGS. 21-24, bracket 90 is shaped to follow outer shape 37 of bar 31 and includes angle markings 91. It is best seen in FIG. 22 that gripper 40 has a reference line 48 which points to a particular one of angle markings 91 indicating the angle of light fixture 10 with respect to the static structure such as round tenon 2 or square pole 2A.

FIGS. 2 and 7 show first bar-engaging portion 43 including a pole-engaging portion 430 configured for securement with respect to pole 12. Second bar-engagement portion 44 is shown configured for attachment to first bar-engagement portion 43 with bar 31 sandwiched therebetween. FIG. 7 shows that first bar-engaging portion 43 defines mounting cavities 431 accepting fasteners 70 which extend through apertures 440 formed through second bar-engagement portion 44.

Figure 5:
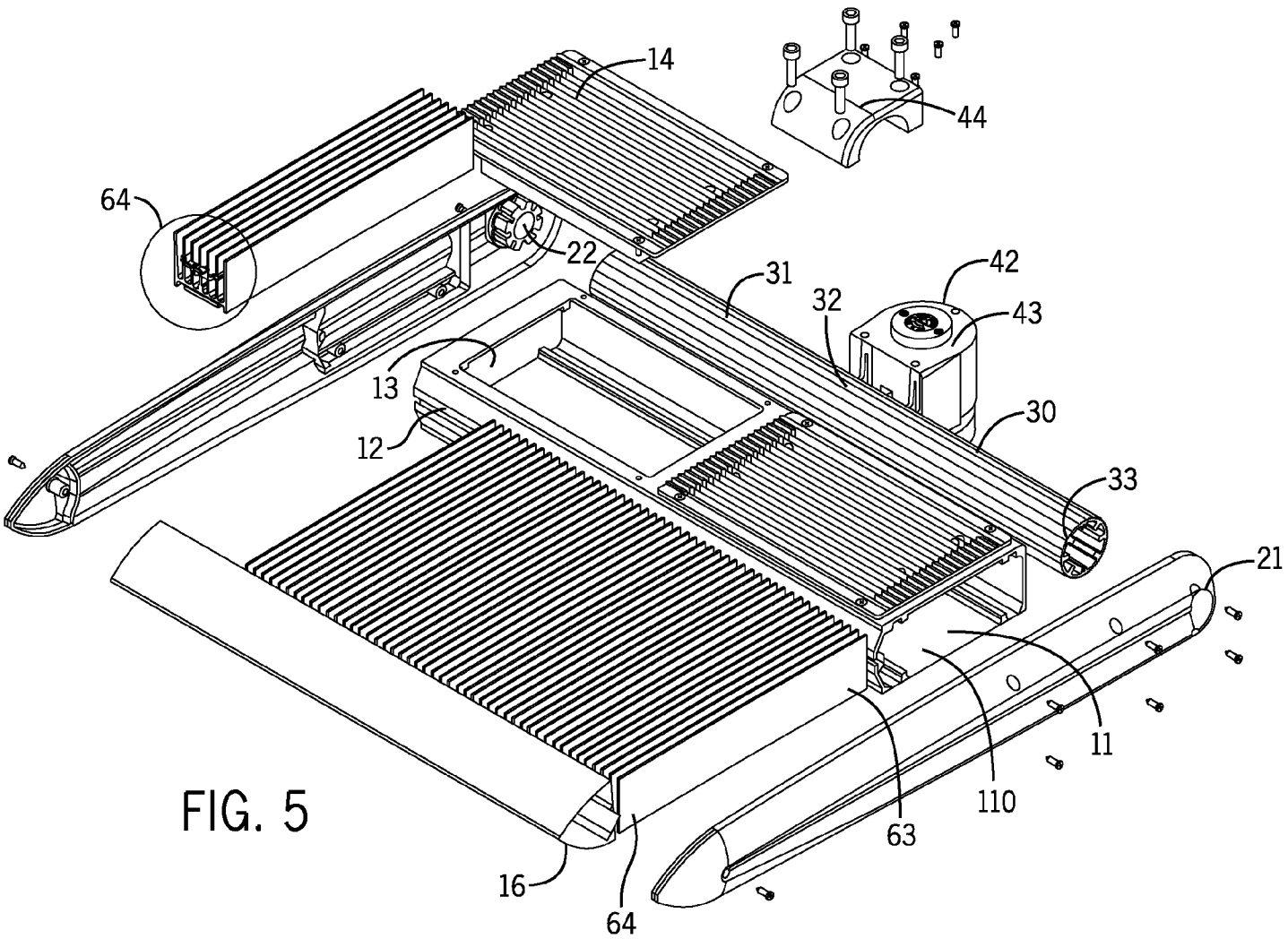
FIG. 5 is an exploded top perspective view of the LED light fixture of FIG. 1.

FIGS. 1-5, 11 and 14 show light fixture 10 further including a closed chamber 11 defined by a driver housing 12 shown in FIG. 5 as an extruded piece. It is further best seen in FIG. 5 that chamber 11 has an access opening 13 and a driver door 14 for placement of an LED driver 15 into chamber 11. In FIGS. 10 and 15, an electronic LED driver 15 is seen enclosed within chamber 11.

Figure 19:
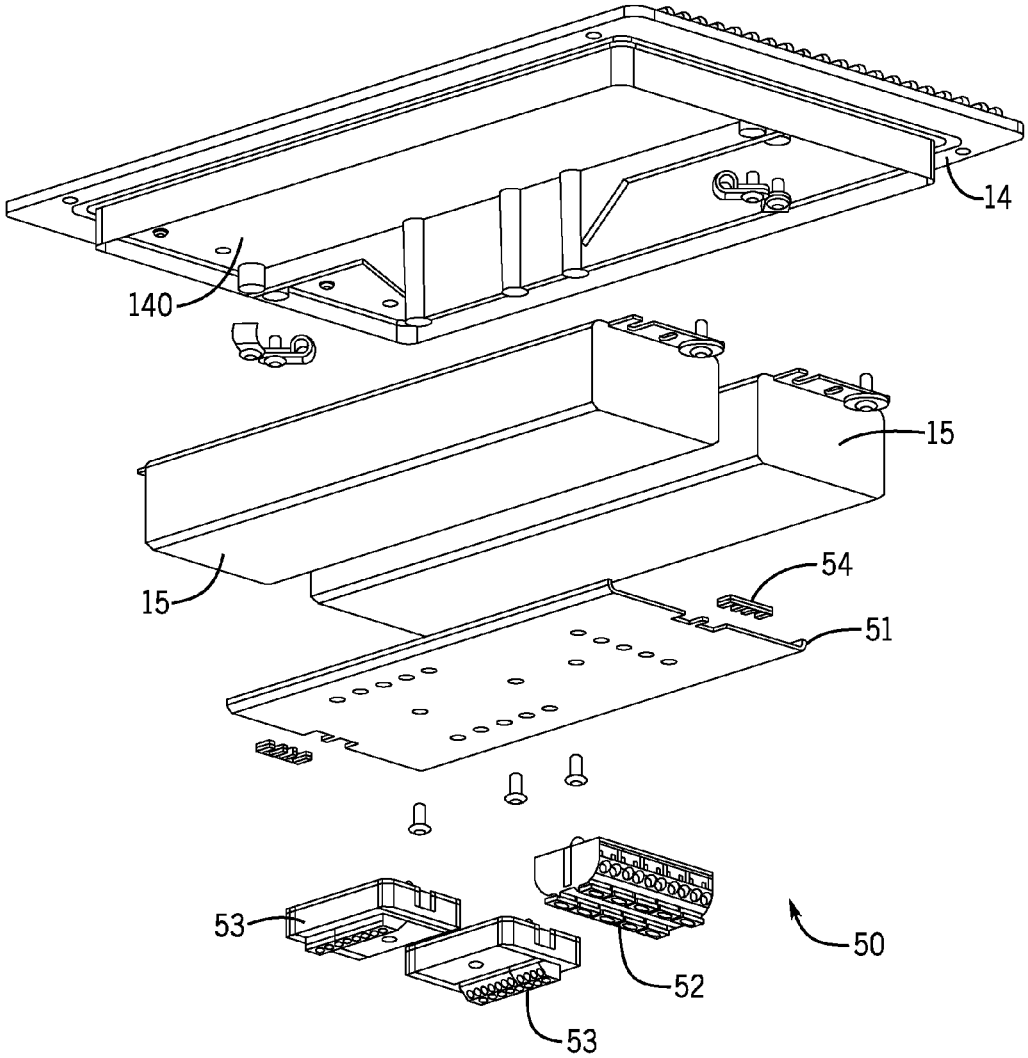
FIG. 19 is a perspective view of an LED driver module of light fixtures of FIG. 1
Figure 20:
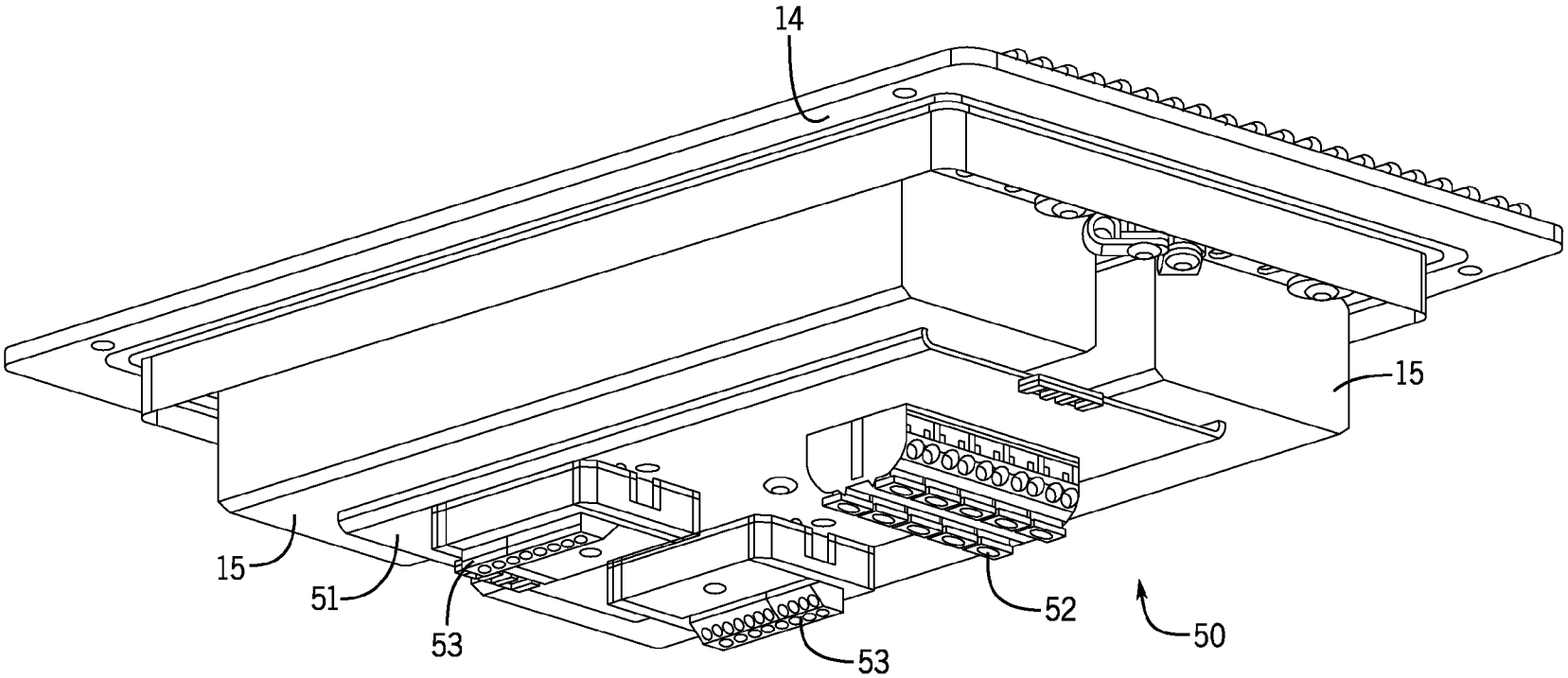
FIG. 20 is an exploded perspective view of the LED driver module of FIG. 19.
Figure 21:
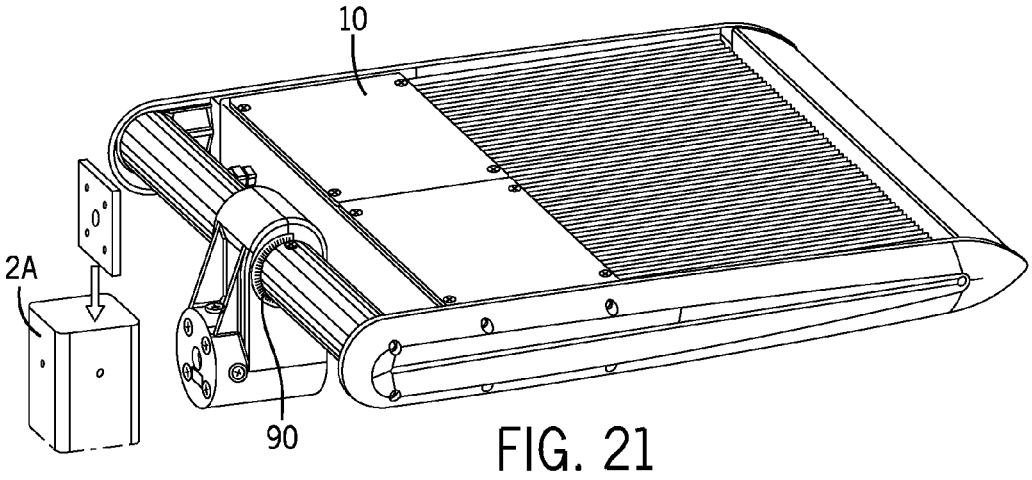
FIG. 21 is a perspective view of the LED light fixture in a position for installation to a square pole, the mounting assembly including a bracket indicating an angle of the light fixture with respect to the pole.

FIGS. 19 and 20 illustrate a driver module 50 including two LED drivers 15 attached to driver door 14 and secured with a mounting plate 51 which supports a terminal block 52, secondary-surge elements 53 and wire guards 54. Driver door 14 is shown as a cast piece configured to support LED driver module thereagainst. As seen in FIG. 5, driver module 50 is positioned such that driver-supporting surface 140 of driver door 14 is oriented substantially down such that driver 15 is spaced above bottom 110 of chamber 11 and is away from any water that might access chamber 11 and accumulate along its bottom 110.

FIG. 5 also shows mounting arrangement 30 positioned adjacent driver housing 11 with bar 31 extending along driver housing 11 and spaced therefrom (also shown in FIGS. 3 and 4).

FIG. 7 shows that first bar-engaging portion 43 further includes a pole-connecting section 42 enclosing wiring 46 and electrical elements such as a terminal block 47 and having a weather-proof wire access 45 thereto for electrical connection of light fixture 10. As seen in FIGS. 6-7, pole-connecting section 42 forms an enclosure 420 accessible through an opening 421 with a cover assembly 80 including a cover plate 81 and a gasket 82. Edge 83 defines fastener receiving cavities 84 accepting fasteners 85 which press cover plate 81 against an edge 83 of opening 421 with gasket 82 sandwiched therebetween. Cover plate 81 defines an aperture 810 which is closeable with a lock-closure 86.

While the principles of the invention have been shown and described in connection with specific embodiments, it is to be understood that such embodiments are by way of example and are not limiting.

The invention claimed is:

1. An LED light fixture comprising a plurality of heat sinks and a plurality of LED-array modules each engaging a base of a corresponding heat sink for transfer of heat from the module, each heat-sink base defining at least one venting aperture therethrough and being wider than the module thereon such that the heat-sink base includes a beyond-module portion, the at least one venting aperture including at least one venting aperture through the beyond-module portion of the heat-sink base.

2. The LED light fixture of claim 1 wherein:

the heat-sink base includes a second beyond-module portion, the two beyond-module portions of the heat-sink base being along opposite sides of the module; and the at least one venting aperture also includes at least one venting aperture through the second beyond-module portion.

3. The LED light fixture of claim 2 wherein the at least one venting aperture includes at least two venting apertures along each of the beyond-module portions.

4. The LED light fixture of claim 3 wherein:

the heat sinks have heat-dissipating surfaces including surfaces of at least one edge-adjacent fin extending transversely from each of the beyond-module portions at positions beyond the venting apertures therealong;

the venting apertures along each of the beyond-module portions of the heat-sink base are spaced along an extrusion; and each of the beyond-module portions of the heat-sink base has at least one non-apertured portion extending thereacross to allow heat flow across such beyond-module portion toward the at least one edge-adjacent fin extending therefrom.

5. The LED light fixture of claim 4 wherein:

the venting apertures along each one of the beyond-module portions include two elongate apertures extending along the extrusion in spaced substantially end-to-end relationship; and the at least one non-apertured portion of each one of the beyond-module portions of the heat-sink base includes a non-apertured portion which is between the two elongate apertures and is located substantially centrally along the length of the extrusion.

6. The LED light fixture of claim 5 wherein the combined length of the apertures along each of the beyond-module portions constitutes a majority of the length of the extrusion.

7. The LED light fixture of claim 4 wherein:

the heat-sink base includes a module-engaging portion between the beyond-module portions; and the heat-sink heat-dissipating surfaces include the surfaces of a plurality of middle fins extending transversely from the module-engaging portion of the heat-sink base.

8. The LED light fixture of claim 7 wherein the edge-adjacent fins extending from each one of the beyond-module portions of the heat-sink base is a single edge-adjacent fin, such two edge-adjacent fins forming the opposite lateral sides of the extrusion.

9. The LED light fixture of claim 8 wherein the heat-sink base has a thickness at positions adjacent to the edge-adjacent fins that is greater than the thickness of the base at positions adjacent to some of the middle fins, thereby to facilitate conduction of heat laterally away from the module.

10. The LED light fixture of claim 8 wherein each of the fins has a base-adjacent proximal portion integrally joined to the heat-sink base and a distal edge remote therefrom, the proximal portions of the edge-adjacent fins being thicker than the proximal portions of at least some of the middle fins, thereby to facilitate conduction of heat away from the module.

11. The LED light fixture of claim 10 wherein the heat-sink base has a thickness at positions adjacent to the edge-adjacent fins that is greater than the thickness of the base at positions adjacent to some of the middle fins, thereby to facilitate conduction of heat laterally away from the module.

12. The LED light fixture of claim 8 wherein:

all of the fins extend away from the heat-sink base in a first direction; and the edge-adjacent fins also extend from the heat-sink base in a second direction opposite to the first direction to provide an additional heat-dissipating surface.

13. The LED light fixture of claim 1 wherein the plurality of heat sinks are beside one another in positions such that the beyond-module portion of each of the heat sinks is adjacent to but spaced from the beyond-module portion of another of the heat sinks, thereby further facilitating flow of cool air to the heat-dissipating surfaces of the heat sinks and thermal isolation of the heat sinks from one another.

14. The LED light fixture of claim 13 wherein the spacing between the heat sinks is at least as great as the widths of the venting apertures in the beyond-module portions of the heat-sink bases.

15. The LED lighting fixture of claim 1 wherein each heat sink comprises a plurality of fins extending away from the base in a first direction, the fins including first and second fins along the opposite edges of the base, the first and second edge-adjacent fins also extending from the base in a second direction opposite to the first direction.

16. An LED light fixture comprising:

a plurality of heat sinks each with its own heat-dissipating surfaces and its own heat-sink base defining at least one venting aperture therethrough to provide air ingress to the heat-dissipating surfaces adjacent to the aperture; and a plurality of LED-array modules each mounted on a corresponding heat-sink base being wider than the module thereon such that the heat-sink base includes a beyond-module portion and defines at least two venting apertures along the beyond-module portion.

17. The LED light fixture of claim 16 wherein:

the heat-sink heat-dissipating surfaces include the surfaces of at least one edge-adjacent fin extending transversely from the beyond-module portion of the heat-sink base at a position beyond the venting apertures therealong;

the venting apertures along the beyond-module portion are spaced along an extrusion; and the beyond-module portion of the heat-sink base has at least one non-apertured portion extending thereacross to allow heat flow across the beyond-module portion toward the at least one edge-adjacent fin extending therefrom.

18. The LED light fixture of claim 17 wherein:

the venting apertures along the beyond-module portion include two elongate apertures extending along the extrusion in spaced substantially end-to-end relationship; and the at least one non-apertured portion includes a non-apertured portion which is between the two elongate apertures and is located substantially centrally along the length of the extrusion.

19. The LED light fixture of claim 18 wherein the combined length of the apertures along the beyond-module portion constitutes a majority of the length of the extrusion.

20. An LED light fixture comprising a housing and an LED assembly which includes a plurality of heat sinks and a plurality of heat-sink-mounted LED-array modules, each heat sink with its own heat-dissipating surfaces and a heat-sink base defining at least one venting aperture therethrough to provide air ingress to the heat-dissipating surfaces adjacent to the aperture, each heat-sink base being wider than the module thereon such that the heat-sink base includes a beyond-module portion, the at least one venting aperture including at least one venting aperture through the beyond-module portion of the heat-sink base, the LED assembly and the housing forming a venting gap therebetween to provide air ingress along the heat-sink base to the heat-dissipating surfaces.

21. The LED light fixture of claim 20 wherein the at least one venting aperture along the beyond-module portion of the heat-sink base includes at least two venting apertures along the beyond-module portion.

22. The LED light fixture of claim 21 wherein:

the heat-sink heat-dissipating surfaces include the surfaces of at least one edge-adjacent fin extending transversely from the beyond-module portion of the heat-sink base at a position beyond the venting apertures therealong;

the venting apertures along the beyond-module portion are spaced along an extrusion; and the beyond-module portion of the heat-sink base has at least one non-apertured portion extending thereacross to allow heat flow across the beyond-module portion toward the at least one edge-adjacent fin extending therefrom.

23. The LED light fixture of claim 22 wherein:

the venting apertures along the beyond-module portion include two elongate apertures extending along the extrusion in spaced substantially end-to-end relationship; and the at least one non-apertured portion includes a non-apertured portion which is between the two elongate apertures and is located substantially centrally along the length of the extrusion.

24. The LED light fixture of claim 23 wherein the combined length of the apertures along the beyond-module portion constitutes a majority of the length of the extrusion.

25. The LED light fixture of claim 20 wherein:

the heat-sink base includes a second beyond-module portion, the two beyond-module portions of the heat-sink base being along opposite sides of the module; and the at least one venting aperture also includes at least one venting aperture through the second beyond-module portion.

26. The LED light fixture of claim 25 wherein the at least one venting aperture includes at least two venting apertures along each of the beyond-module portions.

27. The LED light fixture of claim 26 wherein:

the heat-sink heat-dissipating surfaces include the surfaces of at least one edge-adjacent fin extending transversely from each of the beyond-module portions at positions beyond the venting apertures therealong;

the venting apertures along each of the beyond-module portions of the heat-sink base are spaced along an extrusion; and each of the beyond-module portions of the heat-sink base has at least one non-apertured portion extending thereacross to allow heat flow across such beyond-module portion toward the at least one edge-adjacent fin extending therefrom.

28. The LED light fixture of claim 27 wherein:

the venting apertures along each one of the beyond-module portions include two elongate apertures extending along the extrusion in spaced substantially end-to-end relationship; and the at least one non-apertured portion of each one of the beyond-module portions of the heat-sink base includes a non-apertured portion which is between the two elongate apertures and is located substantially centrally along the length of the extrusion.

29. The LED light fixture of claim 28 wherein the combined length of the apertures along each of the beyond-module portions constitutes a majority of the length of the extrusion.

30. The LED light fixture of claim 27 wherein:

the heat-sink base includes a module-engaging portion between the beyond-module portions; and the heat-sink heat-dissipating surfaces include the surfaces of a plurality of middle fins extending transversely from the module-engaging portion of the heat-sink base.

31. The LED light fixture of claim 30 wherein the edge-adjacent fins extending from each one of the beyond-module portions of the heat-sink base is a single edge-adjacent fin, such two edge-adjacent fins forming the opposite lateral sides of the extrusion.

32. The LED light fixture of claim 31 wherein the heat-sink base has a thickness at positions adjacent to the edge-adjacent fins that is greater than the thickness of the base at positions adjacent to some of the middle fins, thereby to facilitate conduction of heat laterally away from the module.

33. The LED light fixture of claim 31 wherein each of the fins has a base-adjacent proximal portion integrally joined to the heat-sink base and a distal edge remote therefrom, the proximal portions of the edge-adjacent fins being thicker than the proximal portions of at least some of the middle fins, thereby to facilitate conduction of heat away from the module.

34. The LED light fixture of claim 33 wherein the heat-sink base has a thickness at positions adjacent to the edge-adjacent fins that is greater than the thickness of the base at positions adjacent to some of the middle fins, thereby to facilitate conduction of heat laterally away from the module.

35. The LED light fixture of claim 31 wherein:

all of the fins extend away from the heat-sink base in a first direction; and the edge-adjacent fins also extend from the heat-sink base in a second direction opposite to the first direction to provide additional heat-dissipating surface.

36. The LED light fixture of claim 20 wherein the plurality of heat sinks are beside one another in positions such that the beyond-module portion of each of the heat sinks is adjacent to but spaced from the beyond-module portion of another of the heat sinks, thereby further facilitating flow of air to the heat-dissipating surfaces of the heat sinks and thermal isolation of the heat sinks from one another.

37. The LED light fixture of claim 36 wherein the spacing between the heat sinks is at least as great as the widths of the venting apertures in the beyond-module portions of the heat-sink bases.

* * * * *